US007013625B2

(12) United States Patent
Curles

(10) Patent No.: US 7,013,625 B2
(45) Date of Patent: Mar. 21, 2006

(54) BALE BAGGING APPARATUS

(75) Inventor: Curtis Thomas Curles, Cordele, GA (US)

(73) Assignee: CTC Design, Inc., Cordele, GA (US)

( * ) Notice: Subject to any disclaimer, the term of this patent is extended or adjusted under 35 U.S.C. 154(b) by 0 days.

(21) Appl. No.: 10/834,606

(22) Filed: Apr. 29, 2004

(65) Prior Publication Data

US 2004/0216431 A1 Nov. 4, 2004

Related U.S. Application Data

(60) Provisional application No. 60/466,391, filed on Apr. 29, 2003, provisional application No. 60/531,177, filed on Dec. 19, 2003.

(51) Int. Cl.
*B65B 5/04* (2006.01)
*B65B 43/46* (2006.01)
*B65B 39/02* (2006.01)

(52) U.S. Cl. ..... 53/571; 53/261; 53/384.1; 53/386.1; 53/289.7

(58) Field of Classification Search ..... 53/384.1, 53/386.1

See application file for complete search history.

(56) References Cited

U.S. PATENT DOCUMENTS

| | | | | |
|---|---|---|---|---|
| 231,215 A | | 8/1880 | Dederick | |
| 1,628,803 A | * | 5/1927 | Pinter | 53/252 |
| 2,288,603 A | * | 7/1942 | Berch | 53/384.1 |
| 2,850,855 A | * | 9/1958 | Offutt | 53/449 |
| 2,885,850 A | | 5/1959 | Smith | 53/258 |
| 2,973,612 A | * | 3/1961 | McGowan | 53/384.1 |
| 3,044,231 A | * | 7/1962 | Blais et al. | 53/55 |
| 3,451,192 A | | 6/1969 | Irwin | 53/190 |
| 3,503,180 A | | 3/1970 | Myles et al. | 53/258 |
| 3,864,894 A | * | 2/1975 | Sheetz et al. | 53/506 |
| 3,930,352 A | * | 1/1976 | Carnes | 53/572 |
| 3,952,479 A | * | 4/1976 | Achelpohl | 53/570 |
| 4,300,327 A | | 11/1981 | Bridger | 53/258 |
| 4,848,064 A | * | 7/1989 | Lems et al. | 53/459 |
| 5,009,058 A | | 4/1991 | Ptaschek et al. | 53/469 |
| 5,012,631 A | | 5/1991 | Hostetler et al. | 53/588 |
| 5,065,686 A | * | 11/1991 | Foster | 114/102.25 |
| 5,127,212 A | | 7/1992 | Johnsen et al. | 53/540 |
| 5,398,487 A | | 3/1995 | Inman et al. | 53/567 |
| 5,469,693 A | | 11/1995 | Brodrecht | 53/567 |
| 5,628,168 A | | 5/1997 | Inman et al. | 53/567 |
| 6,050,066 A | | 4/2000 | Brodrecht | 53/576 |
| 6,220,001 B1 | | 4/2001 | Brocrecht | 53/567 |
| 6,543,206 B1 | * | 4/2003 | Seward et al. | 53/434 |

* cited by examiner

*Primary Examiner*—John Sipos
(74) *Attorney, Agent, or Firm*—Nelson Mullins Riley & Scarborough, LLP

(57) ABSTRACT

A bagging assembly for use with a bale bagging apparatus is disclosed. The bale bagging apparatus includes a frame assembly, a bale stuffer, and a bale chute. The bagging assembly includes a carriage frame having a first and a second side rail, a pivot end, and a movable end. The pivot end is mounted adjacent the bale chute and the movable end is secured to the frame assembly. A first and a second carriage assembly are movably mounted on the first and the second side rails and each includes an upper and a lower bagger arm that are configured to open simultaneously. A pincher assembly is supported by the upper bagger arms and the lower bagger arms. The pincher assembly is configured to grasp portions of a bale bag, thereby causing the bale bag to open as the upper and lower bagger arms are opened simultaneously.

19 Claims, 27 Drawing Sheets

BALE BAGGING APPARATUS

CROSS REFERENCE TO RELATED APPLICATIONS

This application claims priority to U.S. Provisional Patent Application Ser. No. 60/466,391 filed Apr. 29, 2003, and U.S. Provisional Patent Application Ser. No. 60/531,177 filed Dec. 19, 2003, which are fully incorporated herein by reference in their entirety.

TECHNICAL FIELD

The present disclosure relates generally to a bagging apparatus that assists in placing materials or goods that have been formed into a bale, into a bag for storage, transportation and protection. More specifically, the present disclosure relates a bale bagging apparatus for bagging relatively large bales, such as cotton.

BACKGROUND

It is well-known to protect a previously formed and strapped bale of cotton by covering the bale with a bag. Existing bale bagging devices typically require a minimum of at least two laborers to extend an open end of a bag over a bale chute in preparation for the bale to be urged through the bale chute and subsequently into the bag. As well, at least two laborers must remain in position holding the bag on the bale chute until the bale is actually urged into the bag, which prevents the laborers from performing other necessary tasks during the bailing process. It is not uncommon during the process of urging the bale into the bale chute for the bale to become slightly off-center, at which time laborers frequently attempt to physically center the bale in the bale chute. In that cotton bales frequently weigh as much as 500 pounds, it is not uncommon for laborers to suffer injuries in attempting to manipulate the heavy bales. As well, typical bale bagging devices have many moving parts that can cause serious bodily injury in the instance that a laborer, working in close proximity to the device, entangles clothing, body parts, etc., therein.

Therefore, there is a need for an improved bale bagging assembly which addresses these and other shortcomings of the prior art.

SUMMARY

Briefly described, the present disclosure relates to a bagging apparatus for placing a bale bag about a bale. The bagging apparatus includes a frame assembly including a head frame, a tail frame, a first and a second guide rail, and a bagger frame, the first and second guide rails being secured at a first end to the head frame and at a second end to the tail frame, the first and second guide rails being parallel to each other.

The bagging apparatus also includes a bale stuffer assembly supported between the guide rails and moveable thereon, the bale stuffer assembly including a head with a plurality of guide wheels mounted thereon, and a foot plate extending downwardly from the head. The plurality of guide wheels are arranged and configured to rotatably contact both the first and second guide rails.

A bale chute assembly of the bagging apparatus includes a bale chute and a timing assembly, the bale chute having a first bale chute half and a second bale chute half, the first and second bale chute halves each being pivotally mounted to a portion of the bagger frame such that the first and the second bale chute halves oppose one another. The timing assembly includes a first timing link, a second timing link, and a pinion gear, wherein a first end of the first timing link is rotatably mounted to the first bale chute half and a second end is in communication with the pinion gear. A first end of the second timing link is rotatably mounted to the second bale chute half and the second end is in communication with the pinion gear, the second ends of the first and second timing links being arranged and configured such that rotation of the pinion gear in a first direction urges the first and second timing links in opposite directions.

As well, the bale bagging apparatus includes a bagging assembly having a U-shaped carriage frame having a first side rail and a second side rail, a pivot end, a movable end, and at least one air cylinder. The pivot end includes a first end of the first side rail and a first end of the second side rail each being pivotally mounted on opposing sides of the bale chute, the movable end being secured to the tail frame by the at least one air cylinder.

A first carriage assembly and a second carriage assembly are movably mounted on the first and the second side rail, respectively, both the first and the second carriage assemblies including a carriage mounted to the respective side rail. The carriage assemblies each have an upper bagger arm and a lower bagger arm, the upper and lower bagger arms being rotatably secured to their respective carriage at a first end and being configured to open simultaneously.

A pincher assembly of the bagging apparatus includes an upper pincher bar assembly having a first pair and a second pair of pincher blocks, a lower pincher bar assembly having a first pair and a second pair of pincher blocks, the upper pincher bar assembly being supported by the upper bagger arms and the lower pincher bar assembly being supported by the lower bagger arms. The first and the second upper pairs of pincher blocks and the first and the second lower pairs of pincher blocks are each configured to secure a portion of the bale bag between the pincher blocks of the respective pincher block pair, thereby causing the bale bag to open as the upper and lower pincher bar assemblies are moved in opposite directions.

The present disclosure also relates to a bale stuffer assembly for use with a bale bagging apparatus having a frame assembly with a pair of parallel guide rails, a bale chute having a first bale chute half and a second bale chute half. The bale stuffer assembly includes a head supported between a first and a second guide rail of the pair of parallel guide rails. At least a first pair of guide wheels and a second pair of guide wheels are mounted to the head, the first pair of guide wheels is adjacent the first guide rail and the second pair of guide wheels being adjacent the second guide rail. A foot plate extends downwardly from the head such that as the head is urge along the first and the second guide rails, the foot plate passes between the first chute half and the second chute half.

A further embodiment of the present disclosure includes a bale chute assembly for use with a bale bagging apparatus having a frame and a bale stuffer, the bale stuffer being supported by the frame. The bale chute assembly includes a bale chute including a first bale chute half and a second bale chute half, the first and the second bale chute halves being pivotally mounted to a portion of the frame. The bale chute assembly also includes a timing assembly having a first timing link, a second timing link, and a pinion gear. A first end of the first timing link is rotatably mounted to the first bale chute half and a second end is in communication with the pinion gear, a first end of the second timing link is rotatably mounted to the second bale chute half and the second end is in communication with the pinion gear. The second ends of the first and second timing links are arranged and configured such that rotation of the pinion gear in a first direction urges the first and second timing links in opposite directions.

Yet another embodiment of the present disclosure includes a bagging assembly for use with a bale bagging apparatus having a frame assembly, a bale stuffer supported by and movable along the frame assembly, and a bale chute. The bagging assembly includes a U-shaped carriage frame having a first side rail and a second side rail, a pivot end, a movable end, and at least one air cylinder. The pivot end includes a first end of the first side rail and a first end of the second side rail each being pivotally mounted on opposing sides of the bale chute, the movable end being secured to the tail frame by the at least one air cylinder.

The bagging assembly also includes a first carriage assembly and a second carriage assembly movably mounted on the first and the second side rail, respectively, both the first and the second carriage assemblies including a carriage mounted to the respective side rail. An upper bagger arm and a lower bagger arm are rotatably secured to their respective carriage at a first end and are configured to open simultaneously.

A pincher assembly (of the bagging assembly) includes an upper pincher bar assembly having a first pair and a second pair of pincher blocks, a lower pincher bar assembly including a first pair and a second pair of pincher blocks, the upper pincher bar assembly being supported by the upper bagger arms and the lower pincher bar assembly being supported by the lower bagger arms. The first and the second upper pairs of pincher blocks and the first and the second lower pairs of pincher blocks are each configured to secure a portion of the bale bag between the pincher blocks of the respective pincher block pair, thereby causing the bale bag to open as the upper and lower pincher bar assemblies are moved in opposite directions.

Other objects, features and advantages of the present bale bagging assembly will become apparent upon reading the following specification, taken in conjunction with the accompanying drawings.

BRIEF DESCRIPTION OF THE SEVERAL VIEWS OF THE DRAWINGS

Many aspects of the bale bagging apparatus can be better understood with reference to the following drawings. The components in the drawings are not necessarily to scale, emphasis instead being placed upon clearly illustrating the principles of the present bale bagging apparatus. Moreover, in the drawings, like reference numerals designate corresponding parts throughout the several views.

FIGS. 1A–1K are side views of a bale bagging apparatus constructed in accordance with an embodiment of the present disclosure, showing various steps in the bale bagging process.

DETAILED DESCRIPTION

Figure 1A:
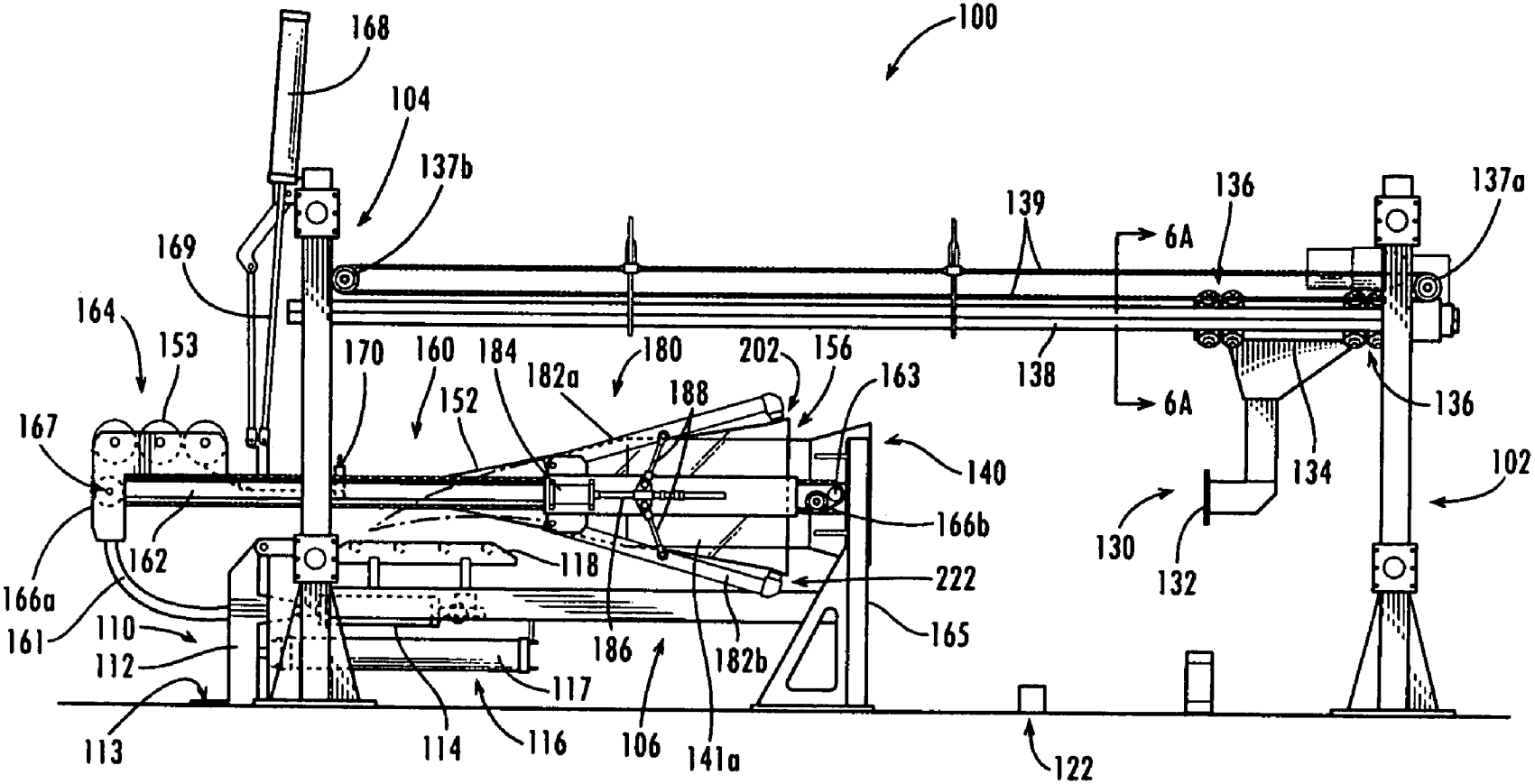

Reference will now be made in detail to the description of the bale bagging apparatus as illustrated in the drawings. While the bale bagging apparatus will be described in connection with these drawings, there is no intent to limit it to the embodiment or embodiments disclosed therein. On the contrary, the intent is to cover all alternatives, modifications and equivalents included within the spirit and scope of the bale bagging apparatus as defined by the appended claims.

Figure 1B:
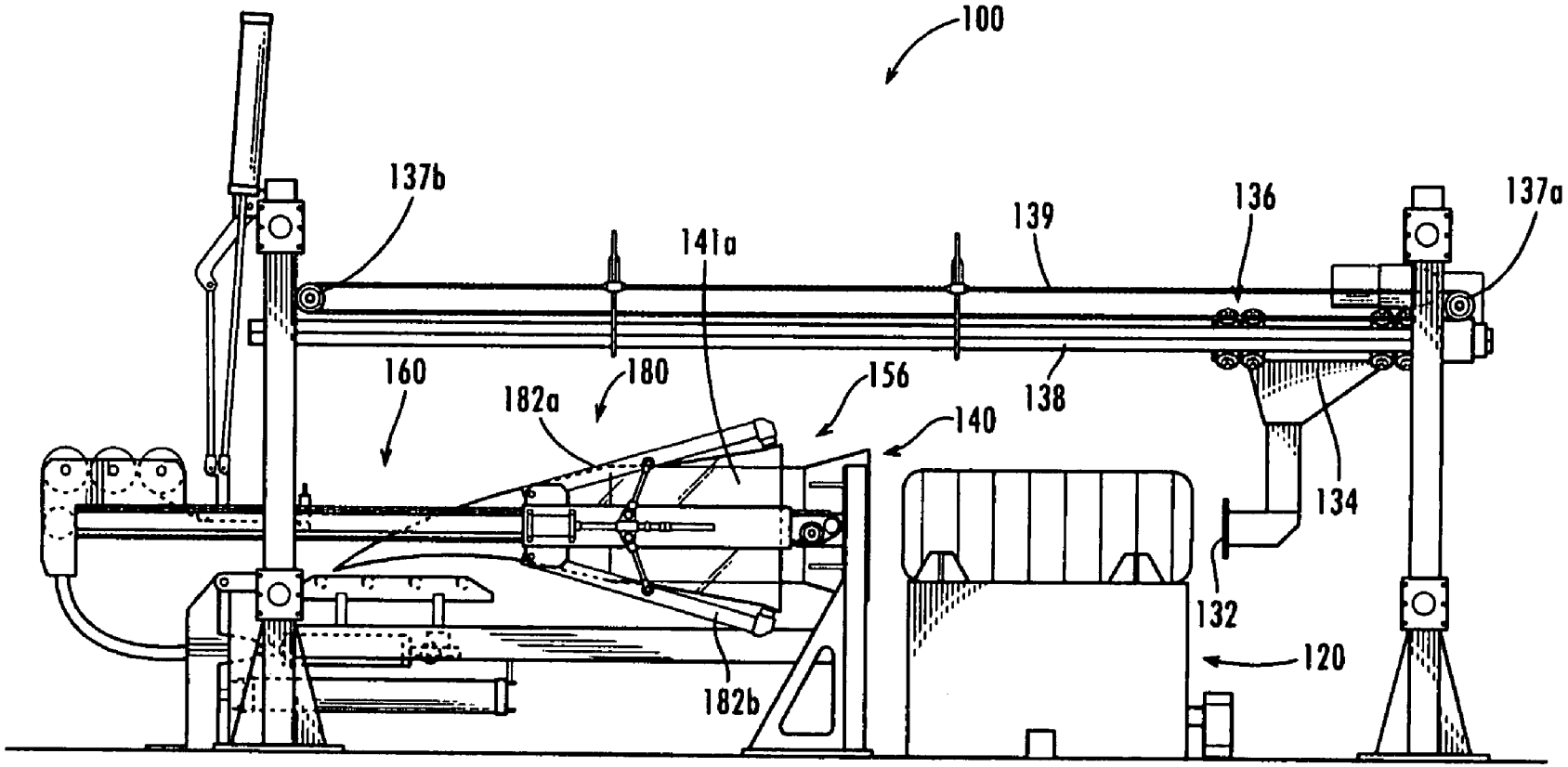
Figure 1C:
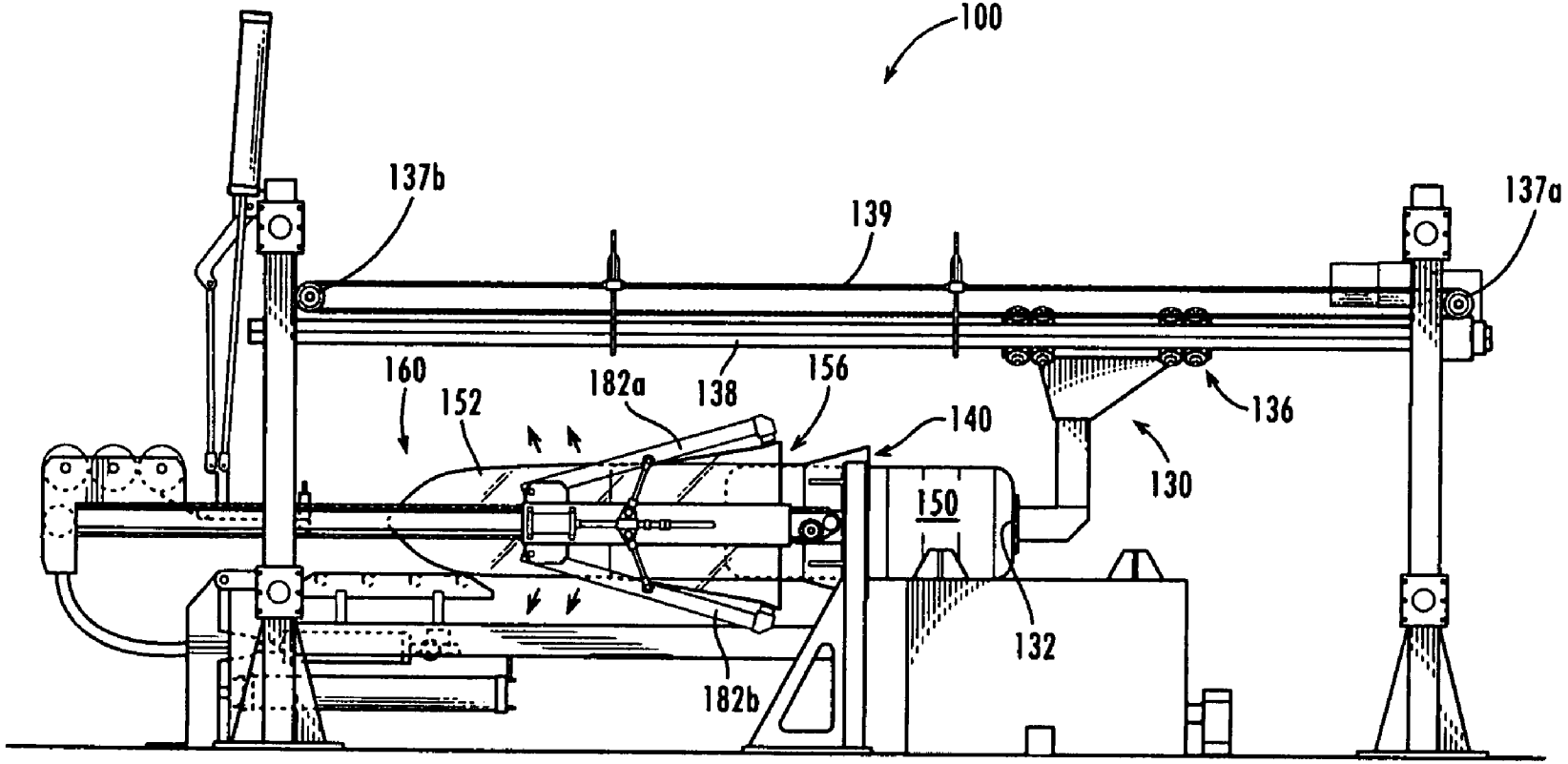
Figure 1D:
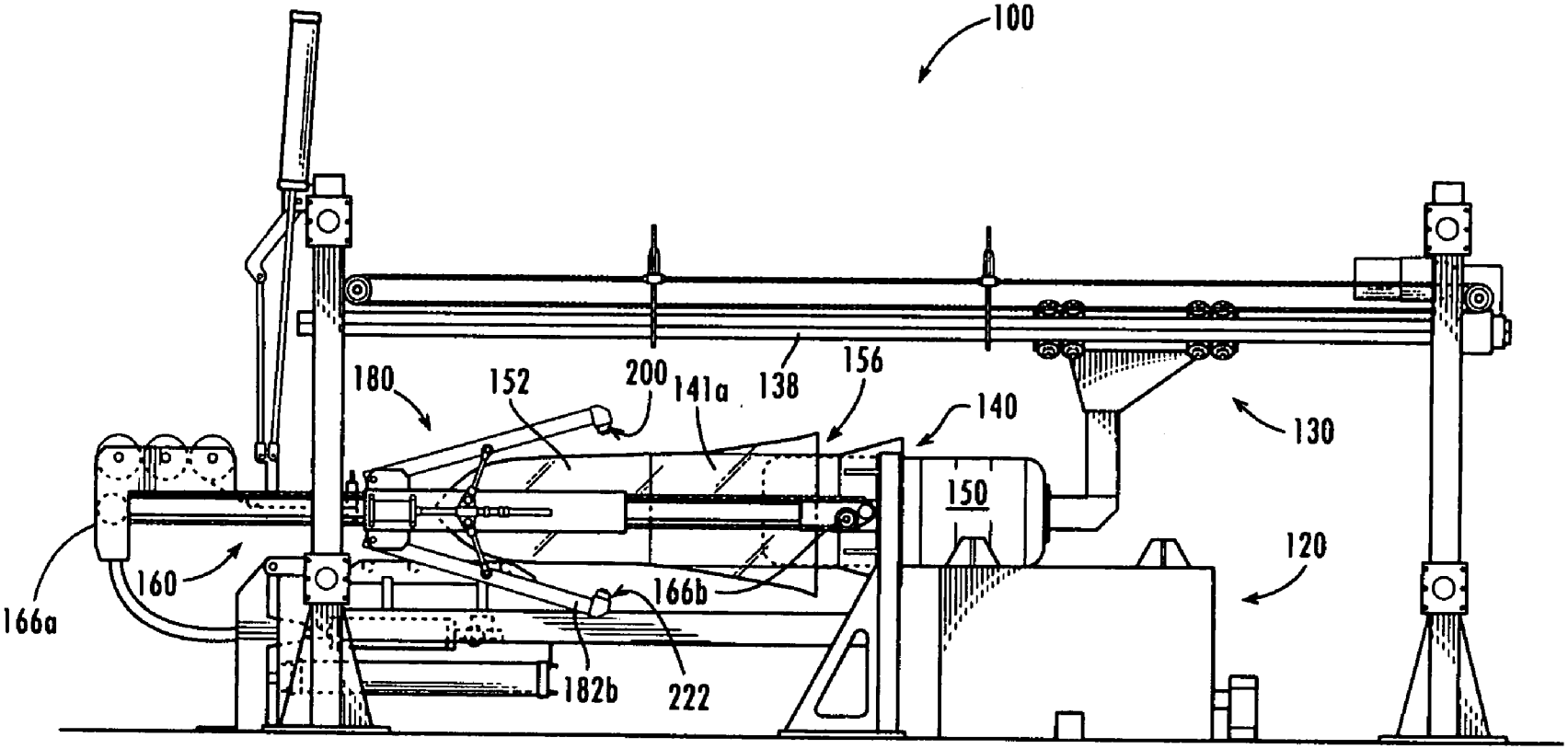
Figure 1E:
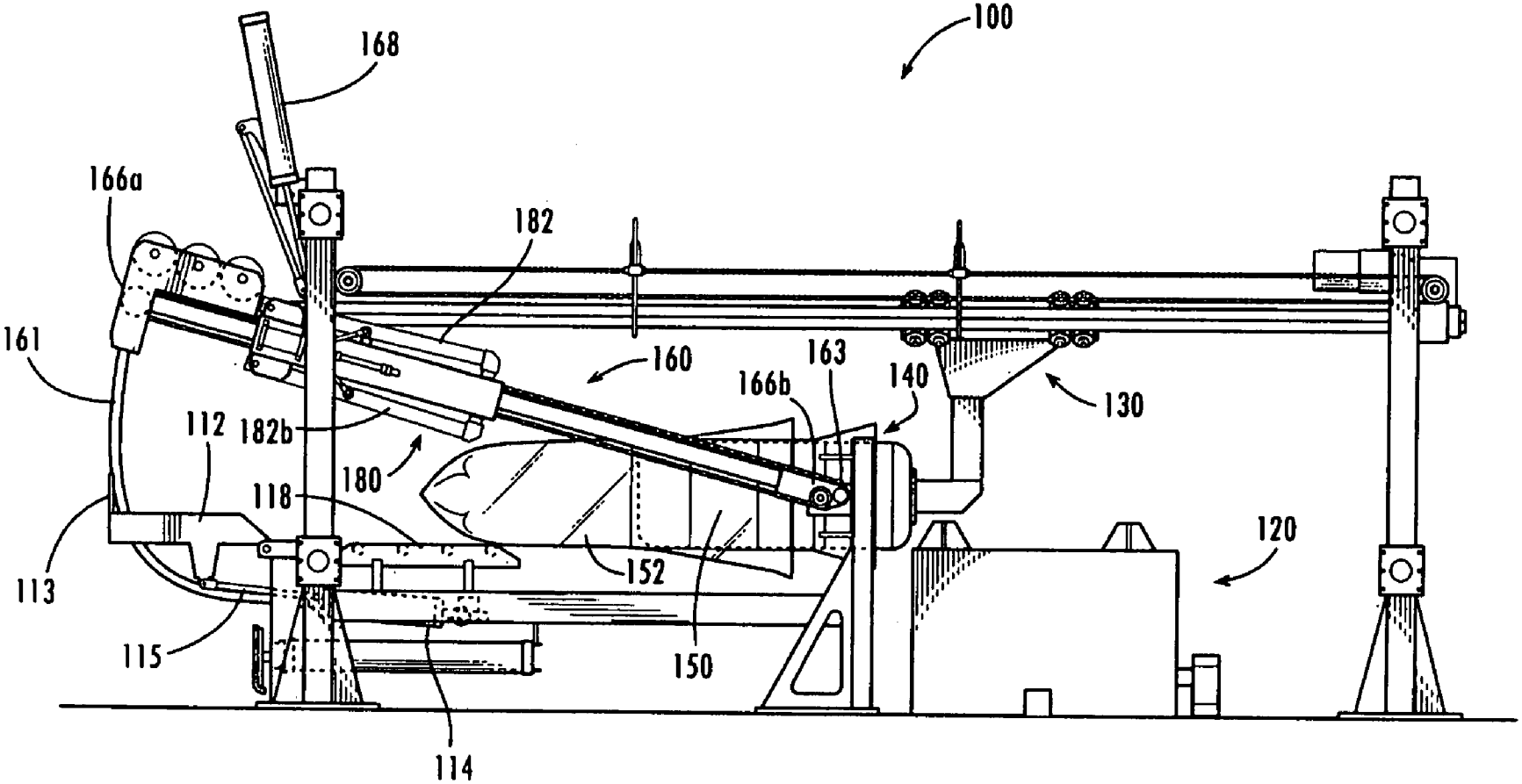
Figure 1F:
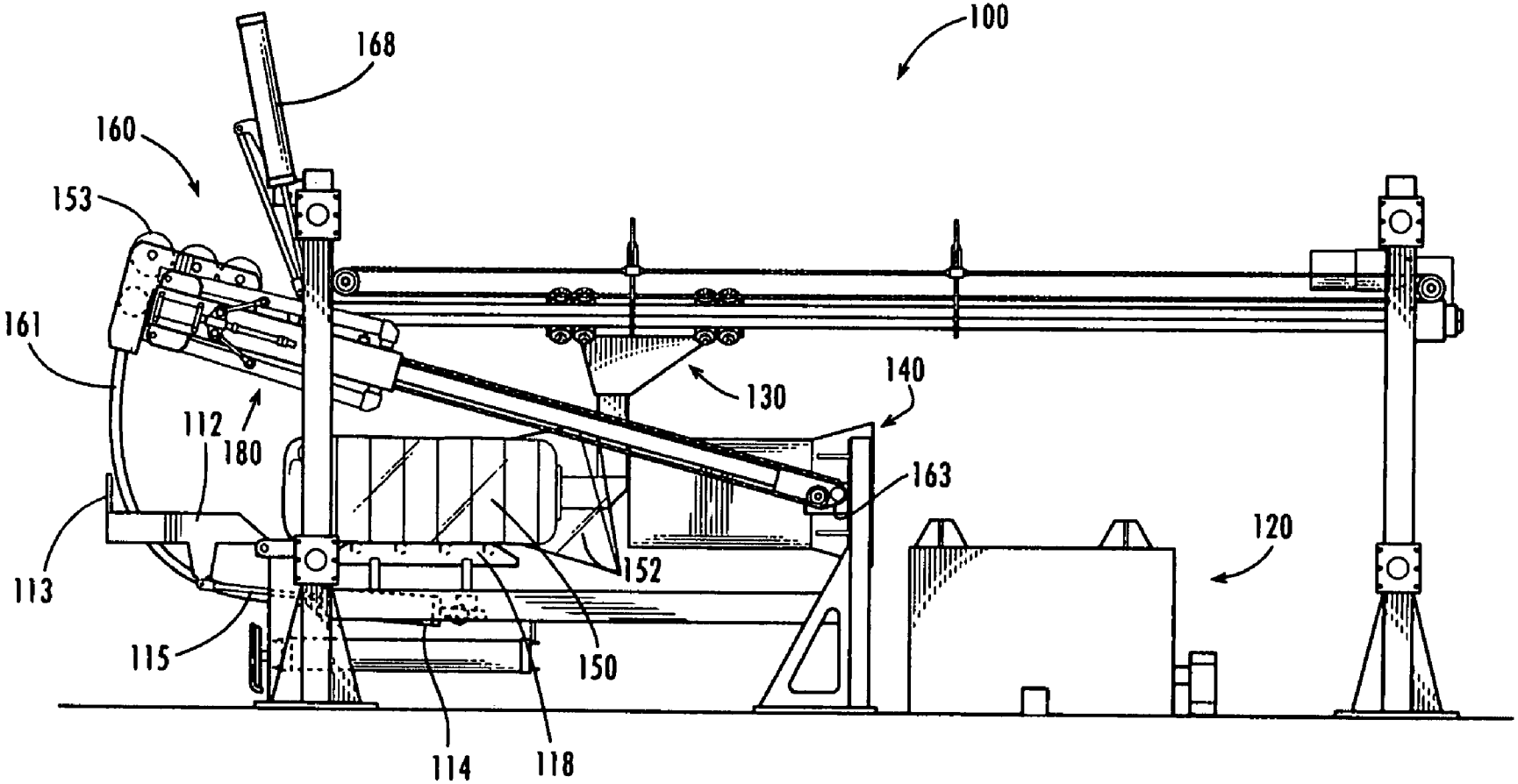
Figure 1G:
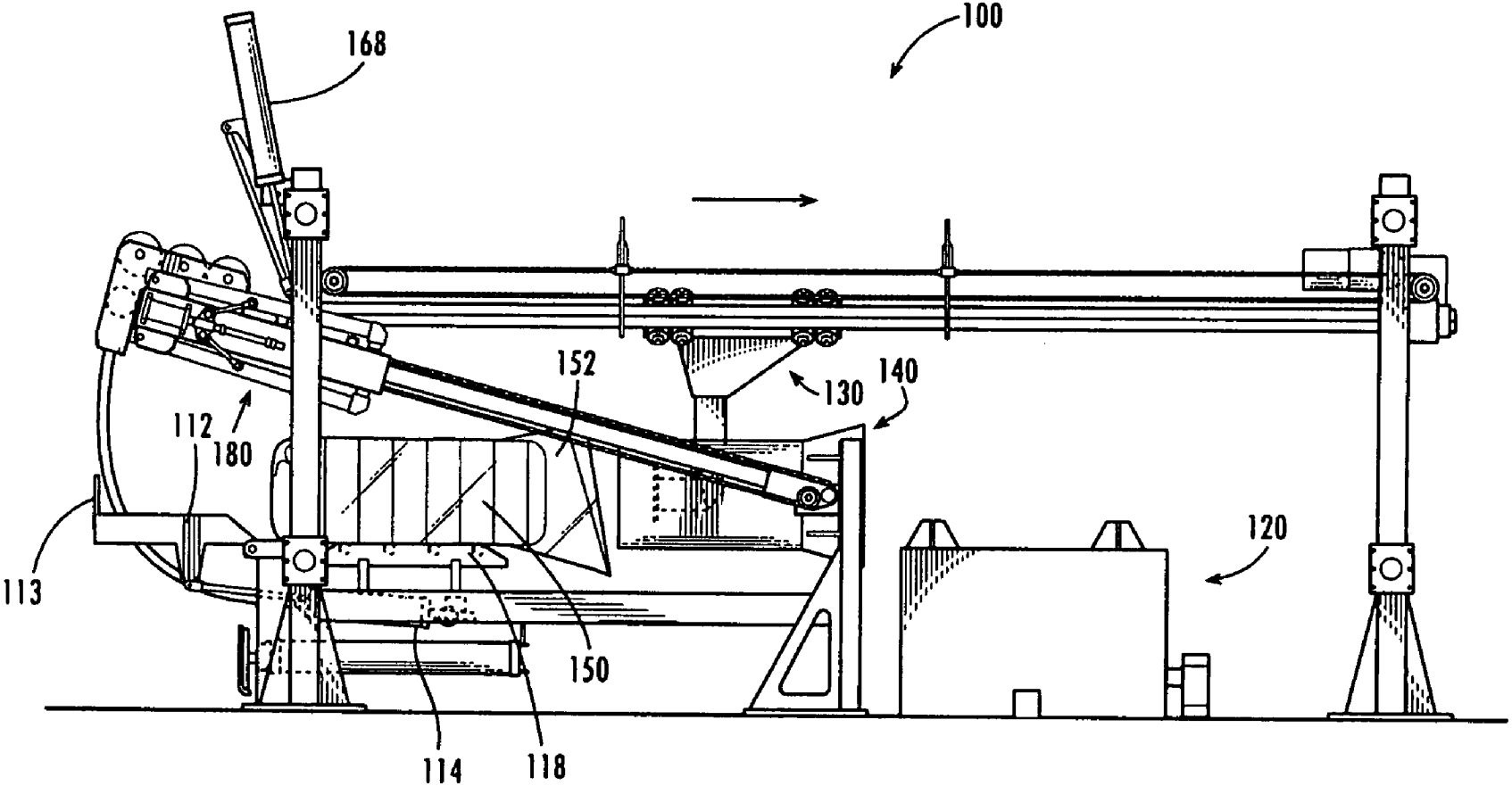
Figure 1H:
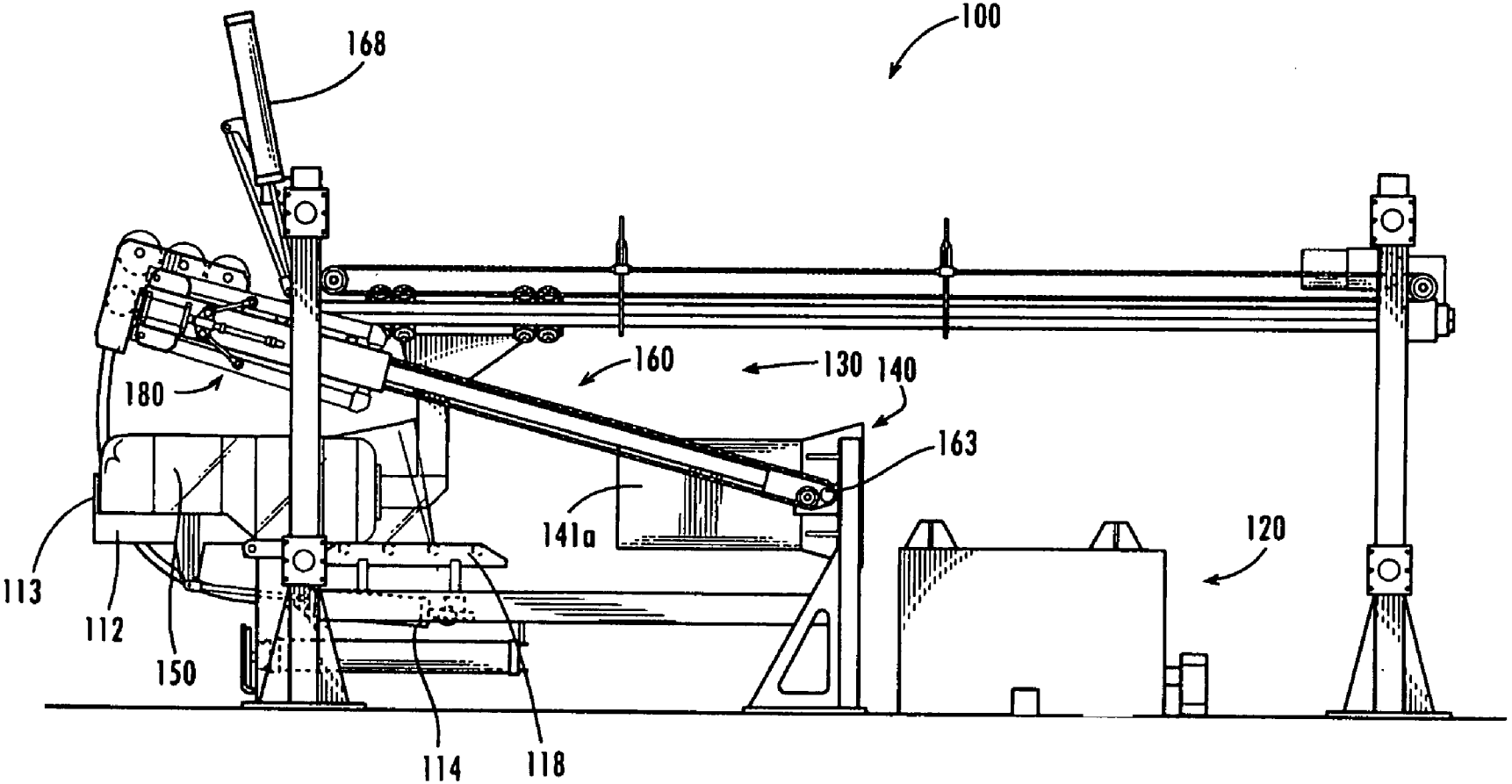
Figure 11:
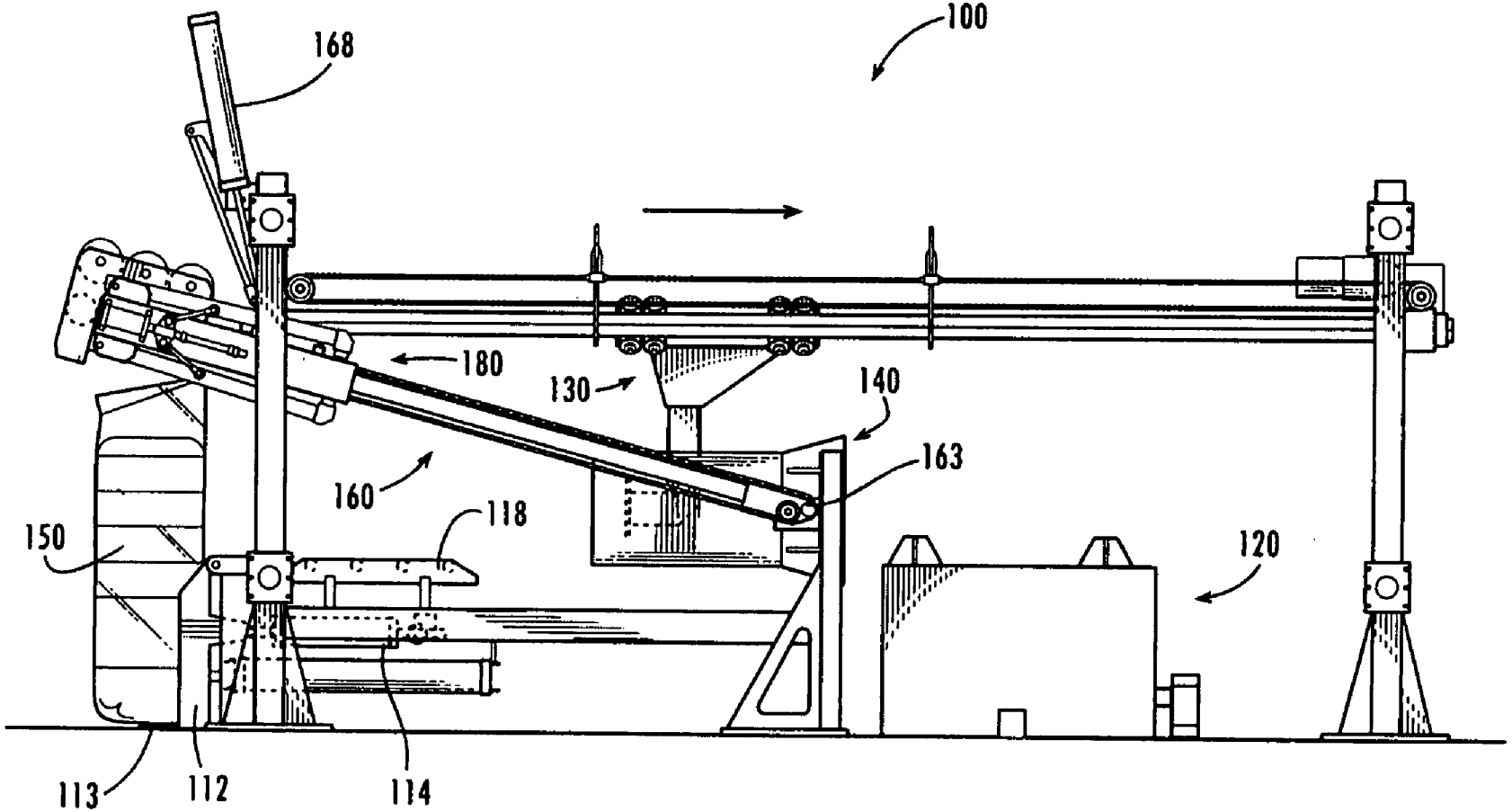
FIGS. 11A–11C are front, bottom and side views of a moving pincher block of the pincher assembly, as shown in FIGS. 10A–10F.
Figure 1J:
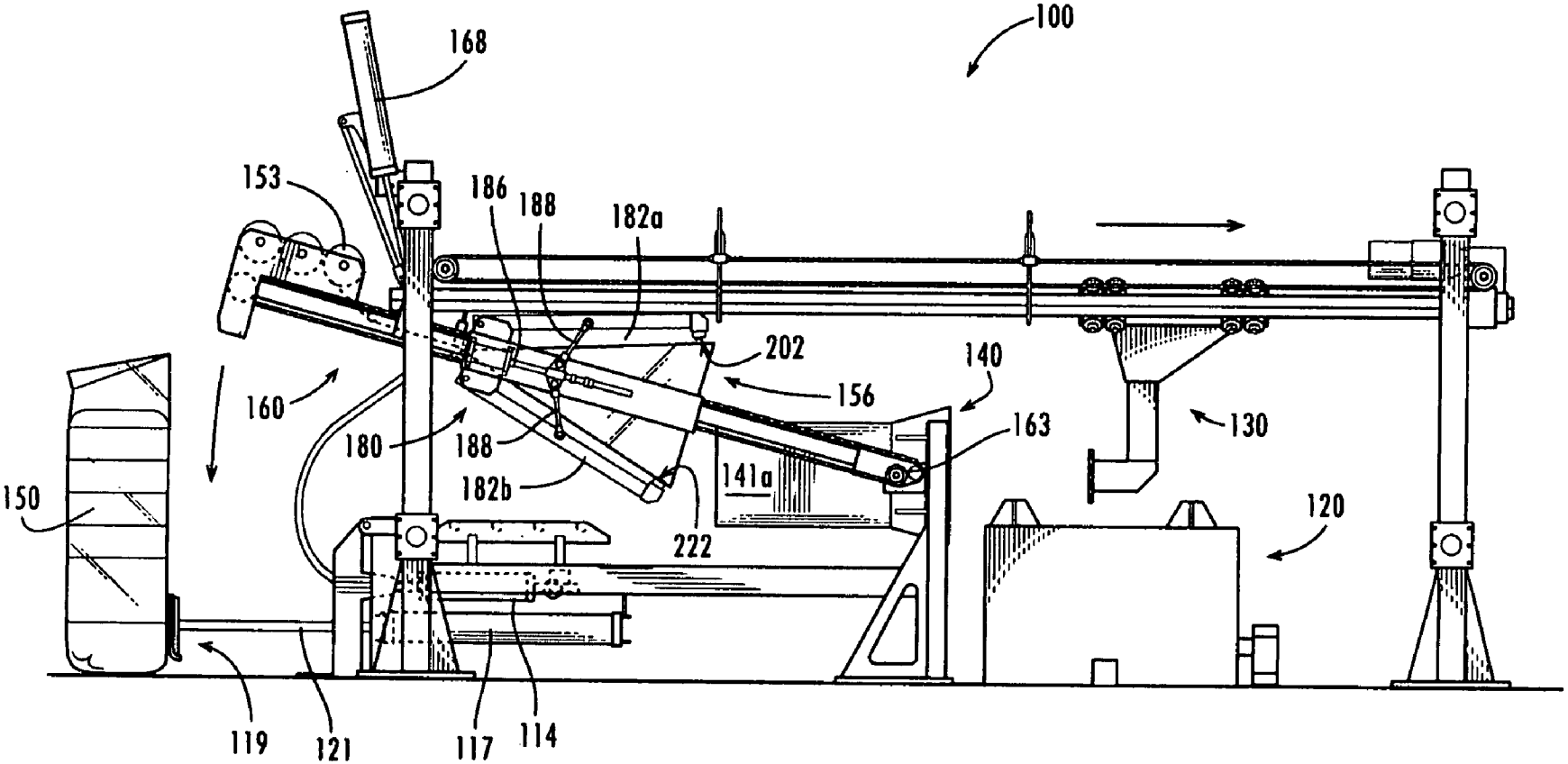
Figure 1K:
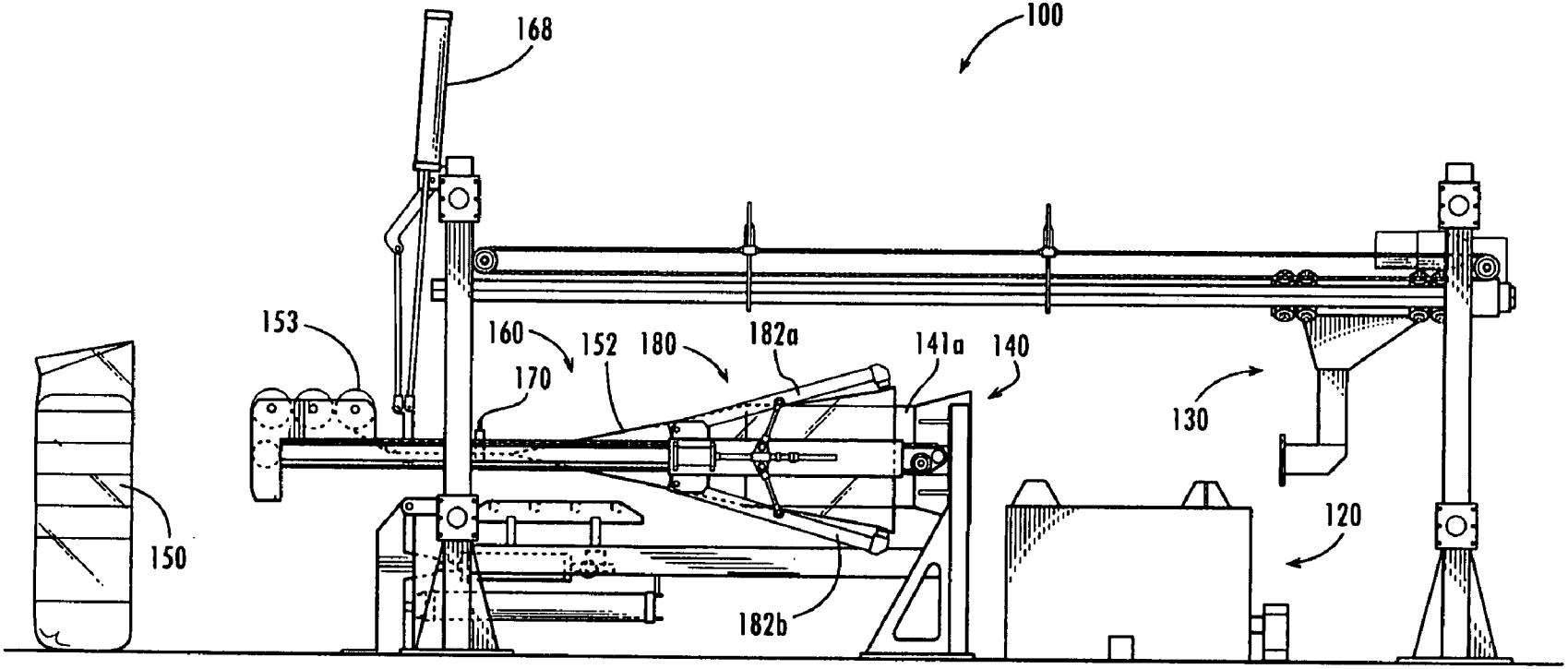
Figure 2:
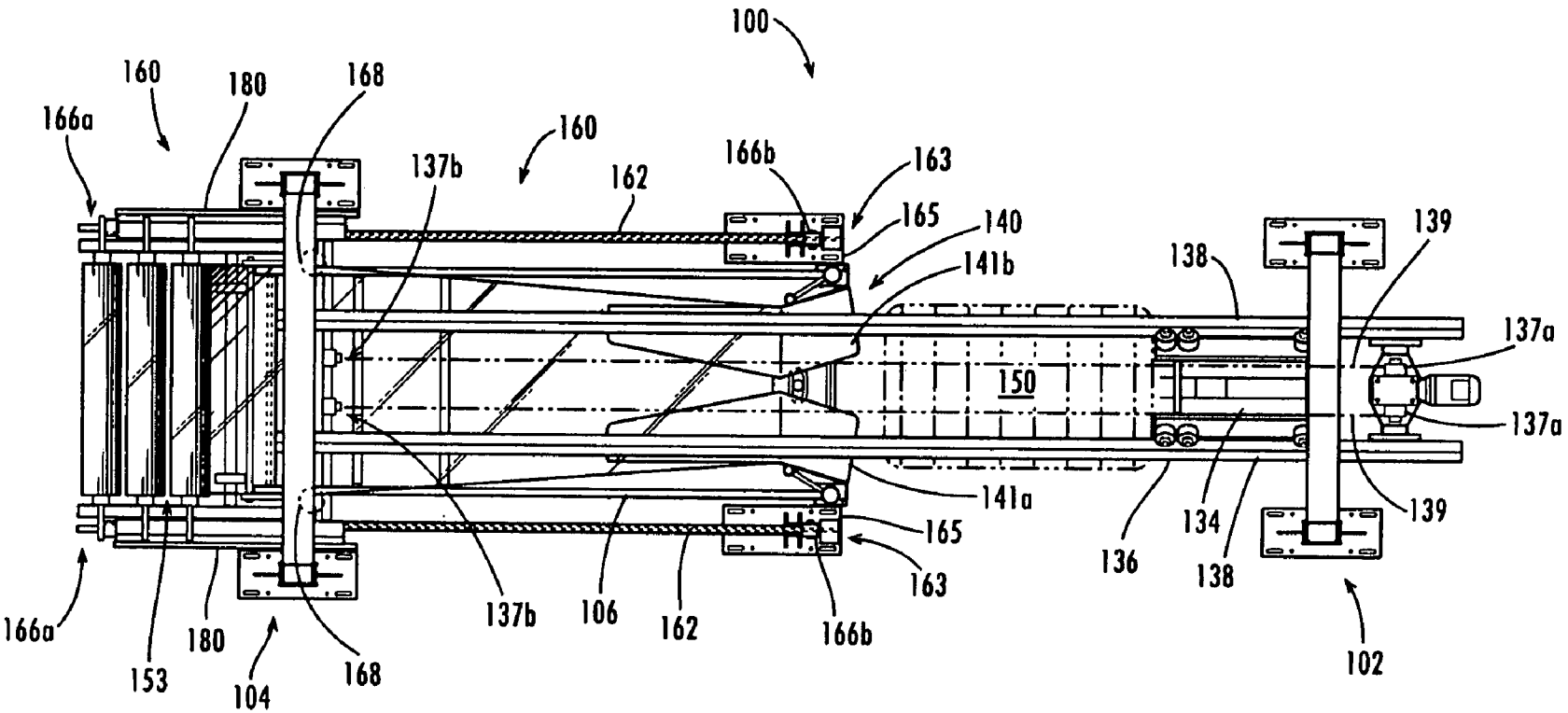
FIG. 2 is a top view of the bale bagging apparatus as shown in FIG. 1.
Figure 3:
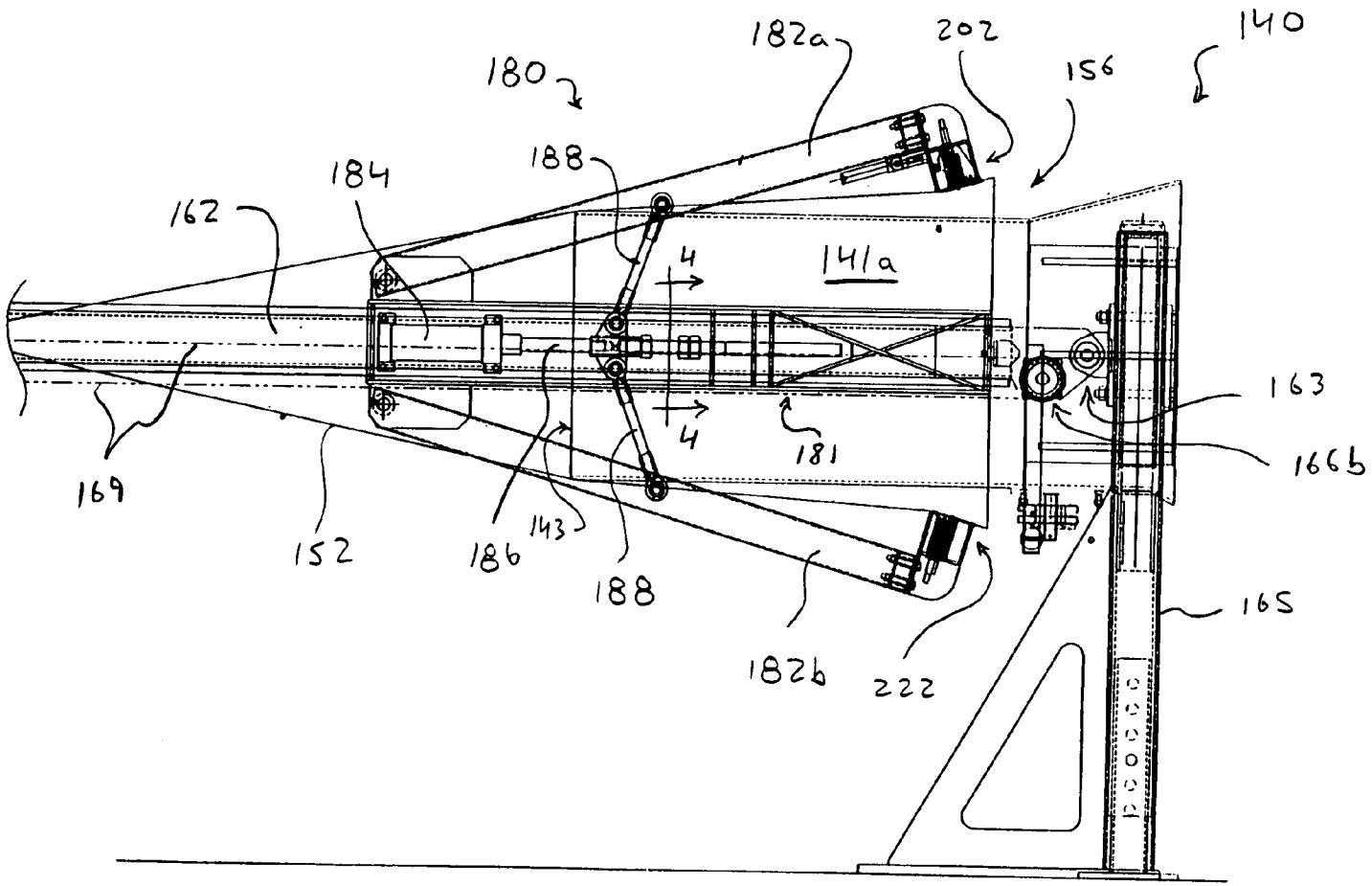
FIG. 3 is a partial side view of the bale bagging apparatus as shown in FIG. 1.

Referring now to FIGS. 1A and 2, a preferred embodiment, among others, of a bale bagging apparatus 100 in accordance with the present disclosure is shown. The bale bagging apparatus 100 includes a head frame 102, a tail frame 104, a bagger frame 106, and a pair of parallel guide rails 138 that run from the head frame 102 to the tail frame 104. As shown, the bale bagging apparatus 100 also includes an up-ender assembly 110, a bale cart 120 (FIG. 1B), a stuffer assembly 130, a bale chute assembly 140, and a pair of carriage assemblies 180, each carriage assembly 180 being supported by a side rail 162 of the carriage frame 160. Typically, bale bagging systems are operated in a continuous fashion once operations are begun. As such, for ease of description, the status of the bale bagging apparatus 100 as shown in FIG. 1 has been chosen to be the position of the assembly when the bale bagging process begins.

Figure 8A:
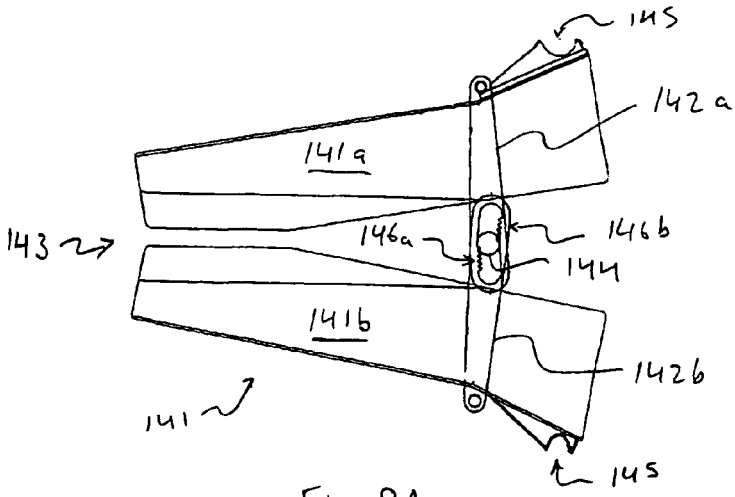
FIGS. 8A–8C are partial views of the bale chute assembly, as shown in FIG. 7, showing the synchronous operation of the bale chute.

In the starting position shown in FIG. 1, the carriage frame 160 is in the down, or horizontal, position and the carriage assemblies 180 are positioning a bale bag 152 about the bale chute which includes chute halves 141*a* and 141*b*. For ease of description, and because the carriage assemblies 180 function in unison, the operation of only one carriage assembly 180 is discussed. The chute halves 141*a* and 141*b* are spring loaded such that their discharge ends 143 are in close proximity to each other when the chute halves 141*a* and 141*b* are in the at rest position prior to a bale entering the bale chute (FIG. 8A). This configuration facilitates placement of the open end 156 of the bale bag 152 about the bale chute. As shown, the upper bagger arm 182*a* and the lower bagger arm 182*b* are in their fully deployed positions with the upper pincher bar assembly 202 and lower pincher bar assembly 222 gripping the open end 156 of the bale bag 152, as will be discussed in greater detail hereafter.

Figure 4:
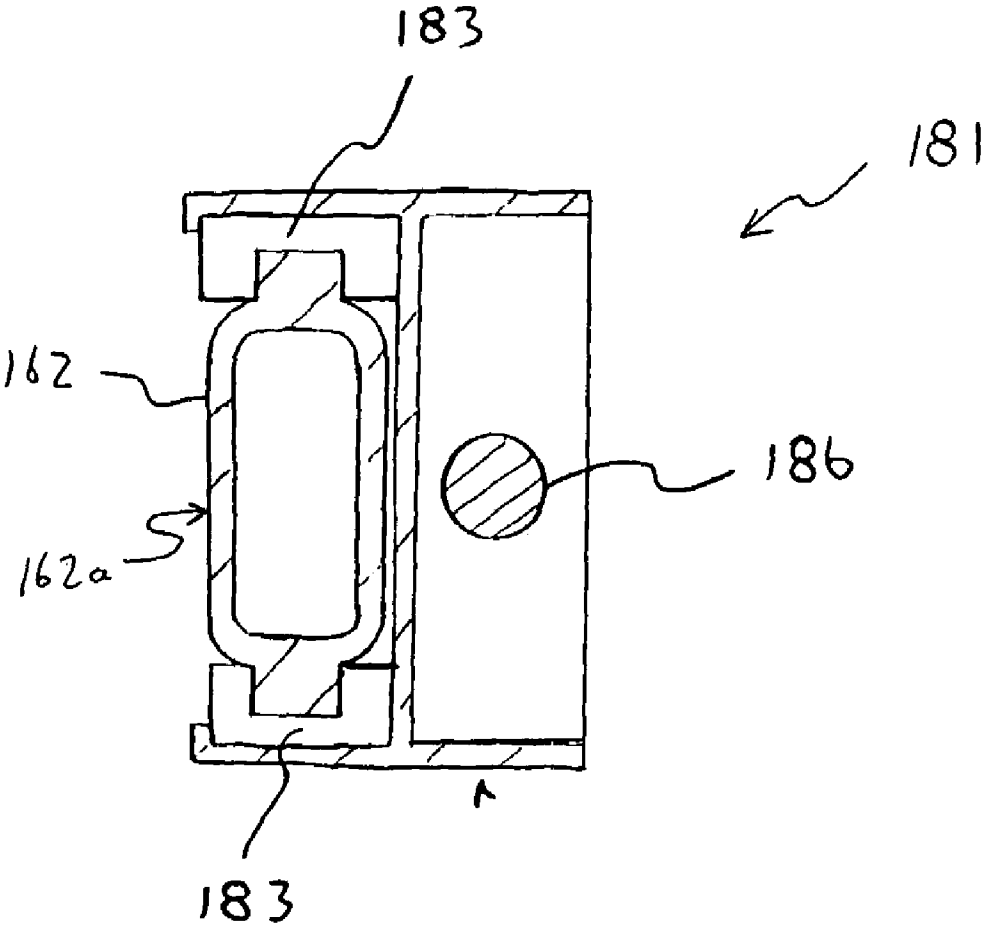
FIG. 4 illustrates a partial, cross-sectional view of the bale bagging apparatus as shown in FIG. 1, taken along line 4—4 of FIG. 3.

As shown, the carriage assembly 180 includes a carriage 181, an arm air cylinder 184, a piston 186, and a pair of links 188. Each link 188 is pivotally connected to the piston 186 at one end and to a respective bagger arm 182*a*, 182*b* at the other. As such, by deploying and retracting the piston 186 from the arm air cylinder 184, each link 188 will cause its respective bagger arm 182*a*, 182*b* to either be deployed from, or retracted back to, the carriage 181. In the preferred embodiment shown, each carriage assembly 180 is urged along its respective side rail 162 of the carriage frame 160 by a chain drive mechanism. To ensure that both carriage assemblies 180 move in concert with each other, the chain drive assembly includes a pair of gears 166*a* that are disposed on ends of a common shaft 167 located at the movable end of the carriage frame 160. An associated set of idler gears 166*b* is located at the pivoting end 163 of the carriage frame 160, with one idler gear 166*b* being mounted on each side rail 162. As best shown in FIG. 4, each carriage 181 is mounted to its respective side rail 162 such that motion of the carriage assembly 180 along the side rail 162 does not interfere with components mounted on the inner surface 162*a* of the side rail 162. Each carriage 181 can include one or more slides 183 to reduce wear of the components and ensure smooth motion of each carriage assembly 180 along its respective side rail 162.

As previously noted, when one embodiment of the bale bagging apparatus 100 is in the starting position shown in FIG. 1A, the carriage frame 160 is in the horizontal position. As such, the pistons 169 of the pair of bagger frame air cylinders 168 are in their fully extended positions. The bagger frame air cylinders 168 are pivotally connected to a portion of the tail frame 104 such that the carriage frame 160 may be rotated upwardly about the carriage frame pivots 163 by retracting the pistons 169 into their respective bagger frame air cylinders 168. Simultaneous operation of the air cylinders 168, and therefore even lifting of the carriage frame 160, is ensured by a torque arm (not shown) that connects the pair of air cylinders 168. A protective sheath 161 is provided to keep various pneumatic lines, wire, etc., from being damaged by movement of the carriage frame 160. As well, when in the start-up position shown, the up-ender assembly 110, pusher assembly 116, and stuffer assembly 130 are all in their at-rest, or "home" positions.

Figure 6A:
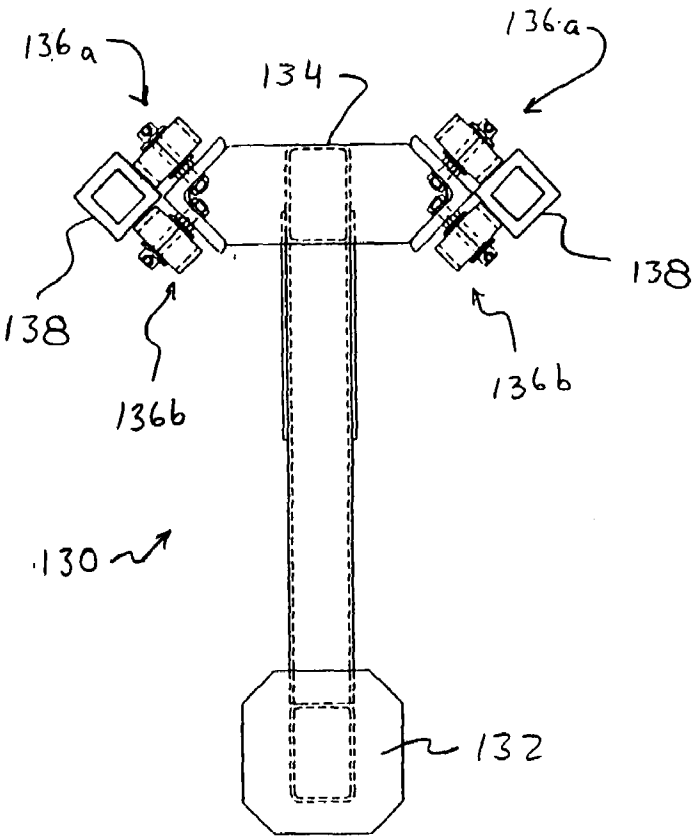
FIGS. 6A and 6B are front and side views, respectively, of the bale stuffer assembly as shown in FIG. 1, taken along line 6A—6A of FIG. 1A.
Figure 6B:
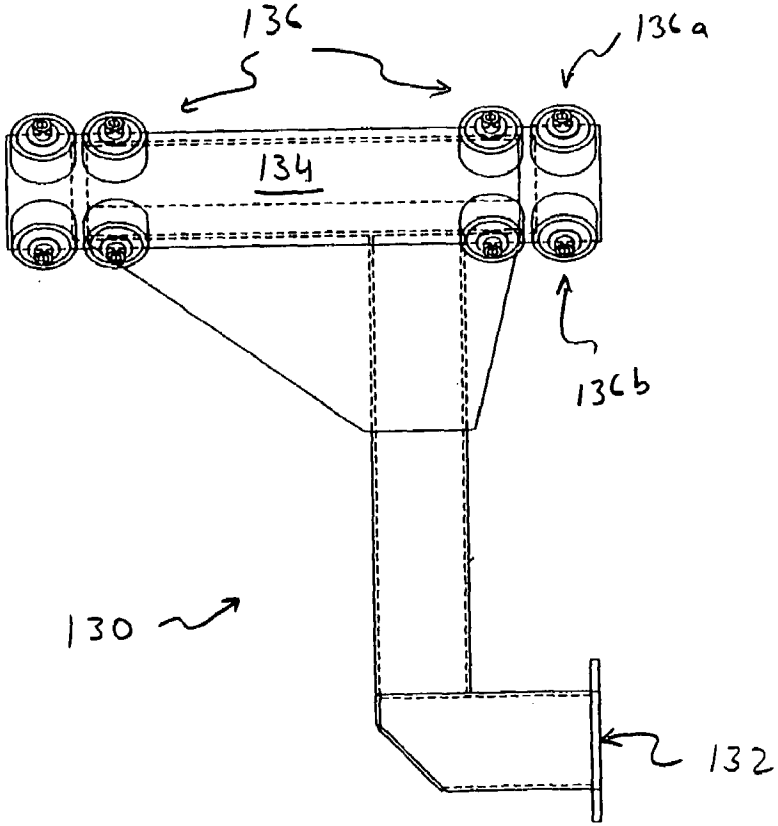

The up-ender assembly 110 includes a tray 112 with a base plate 113, and an air cylinder 114 that is pivotally connected to the bagger frame 106 at one end and pivotally connected to the base plate 112 by the air cylinder piston 115. As such, the tray 112 may be moved between a horizontal position for receiving a bale and a vertical position for placing the bale on a support surface by extending and retracting the piston 115, respectively. The pusher assembly 116 includes an air cylinder 117 and a push plate 119 mounted to the piston 121 thereof (FIG. 1J). The bale stuffer assembly 130 includes a foot plate 132, a head 134 and a plurality of guide wheels 136 that are mounted to the head 134. The guide wheels 136 are arranged such that they make contact with the pair of guide rails 138 that extend between the head frame 102 and the tail frame 104. As best shown in FIG. 6A, the guide wheels 136 are mounted in pairs 136*a*–136*b* to the head 134 such that the first guide wheel 136*a* of each pair contacts an upper portion of the respective guide rail 138 while the second guide wheel 136*b* of the pair contacts a lower portion of the respective guide rail 138. In the preferred embodiment shown, the guide rails 138 are square in cross-section and secured to the bale bagging apparatus 100 such that the pairs of opposed corners lie in the vertical and the horizontal plains. Therefore, each pair of guide wheels 136*a*–136*b* is mounted to the head 134 such that the axis of rotation of the first guide wheel 136*a* is substantially perpendicular to the axis of rotation of the second guide wheel 136*b*. Guide wheels 136 are mounted to the front and rear of the head 134 to help prevent displacement of the head 134 relative to the guide rails 138 when force is exerted on a bale 150 (FIG. 1B) by the foot plate 132.

Figure 5A:
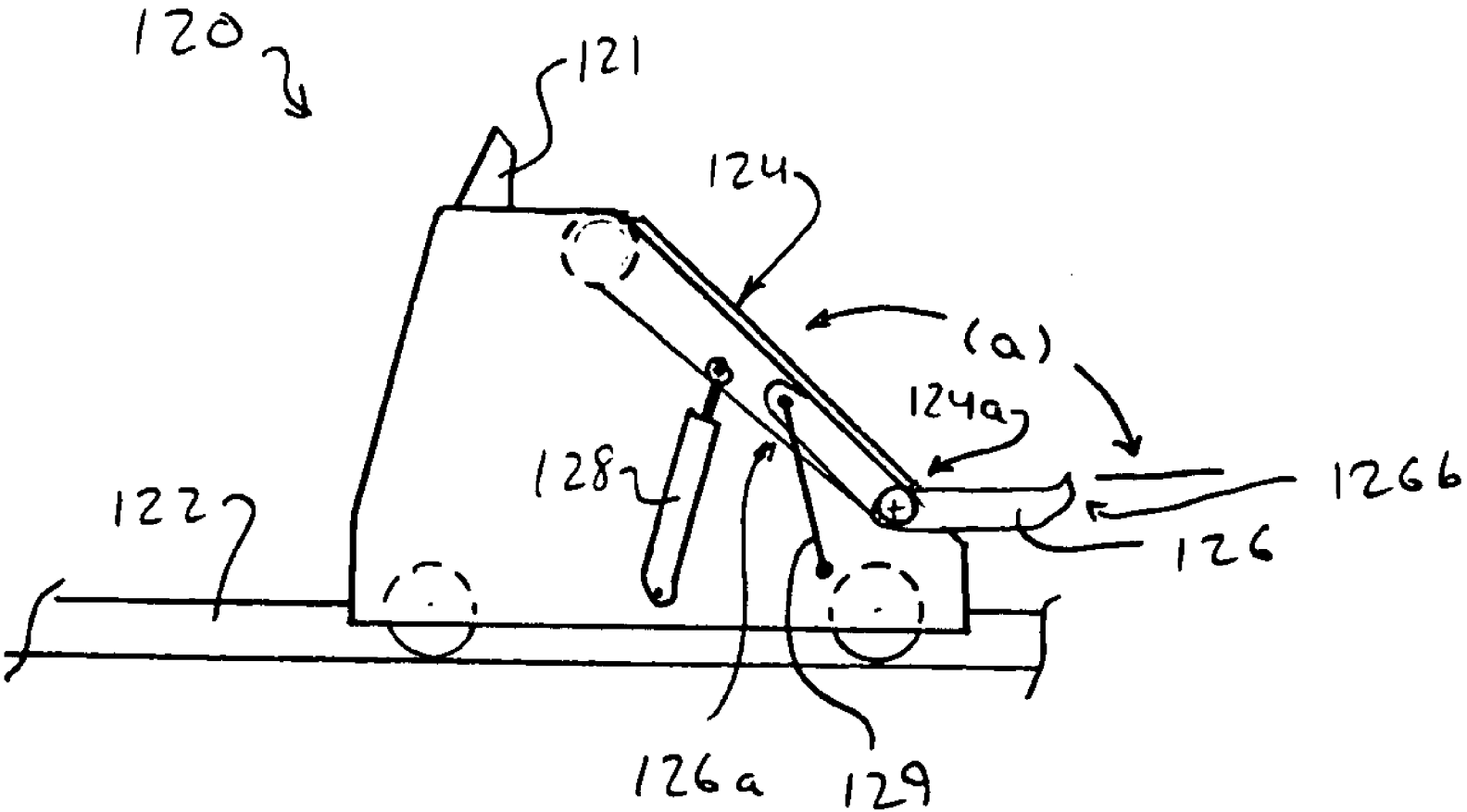
FIGS. 5A and 5B are side views of a bale cart for use with the bale bagging apparatus as shown in FIG. 1.
Figure 5B:
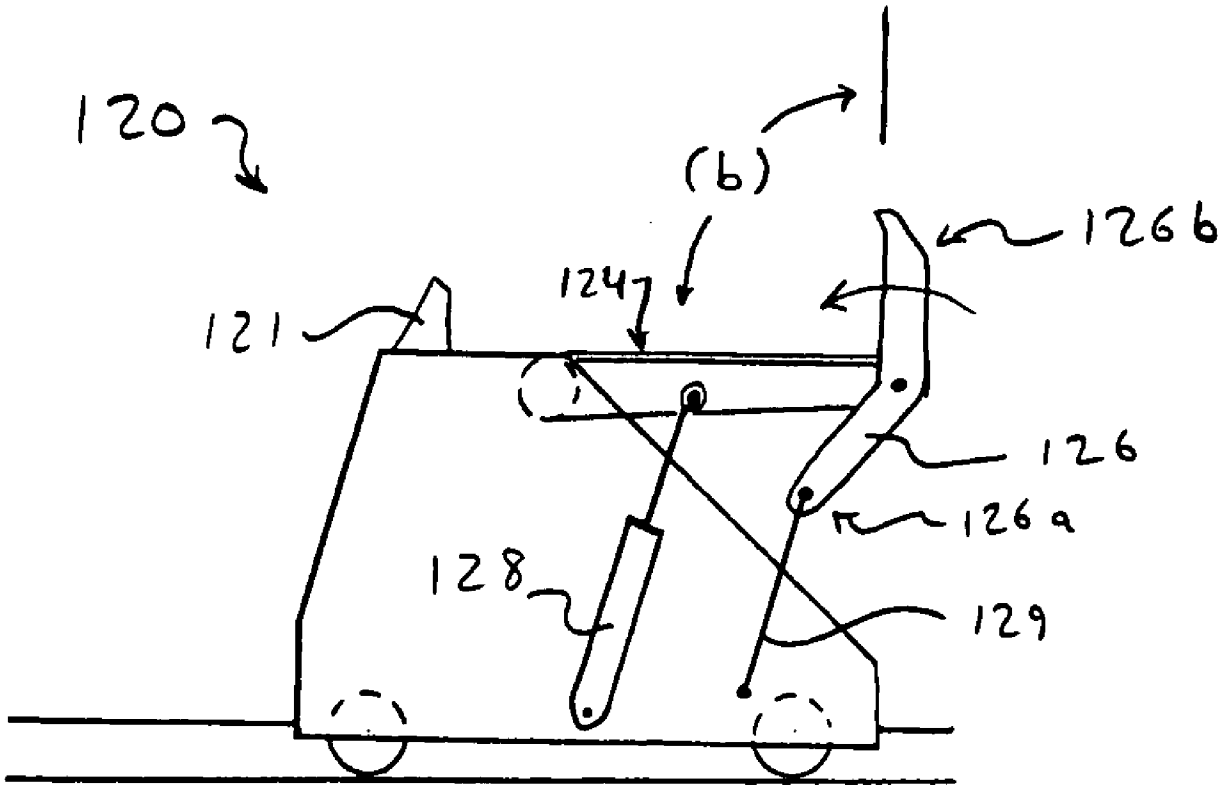

As shown in FIG. 1B, the bale bagging process begins when the bale cart 120 returns from the bale press (not shown) with a bale 150 ready for bagging. The bale cart 120 travels between the bale press and the bale bagging apparatus 100 on a rail 122 that is mounted to the support surface of the bale bagging apparatus 100. As shown in FIGS. 5A and 5B, an embodiment of the bale cart 120 includes a bed 124 and forks 126 that are both rotatable between a receiving position (FIG. 5A) and a bagging position (FIG. 5B). As shown, each fork 126 is pivotally mounted to the distal edge 124*a* of the bed 124. Each fork 126 further includes a linkage that is 129 rotatably secured at the first end to the proximal end 126*a* of the respective fork 126 and that is rotatably secured to the body of the bale cart 120 at the second end. As such, as the bed 124 of the bale 120 is raised, such as by pneumatic or hydraulic cylinders 128, from the receiving position to the baling position, each fork 126 will be rotated about the distal edge 124*a* of the bed 124. Rotation causes the distal end 126*b* of each fork 126 to exert force on the bale 150, thereby urging the bale 150 into the proper position for bagging. More specifically, the bale is urged against the back stops 121 of the bale cart 121. The configuration of the forks 126 and linkages 129 is such that when the bed 124 is in the receiving position, an obtuse angle (a) is formed between the bed 124 and distal end 126*b* of each fork 126 (FIG. 5A). As shown best in FIG. 5B, as the bed 124 is moved into the bagging position, each fork 126 pivots about the distal edge 124*a* such that the resulting angle (b) between the bed 124 and the distal end 126*b* of each fork is approximately 90 degrees.

After the bale cart 120 has returned from the bale press with a cotton bale 150, the bale stuffer assembly 130 is urged along the guide rails 138 until the foot plate 132 comes into contact with the bale 150. The bale stuffer assembly 130 is urged along the guide rails 138 by a dual chain 139 drive system. As shown, each chain 139 of the drive system includes a drive gear 137*a* and an idler gear 137*b*, the drive gear 137*a* being mounted to the head frame 102 and the idler gear 137*b* being mounted to the tail frame 104. A dual chain 139 drive system, along with the dual guide rails 138, helps ensure that the bale stuffer assembly 130 remains properly aligned with the bale 150 as the bale 150 is urged into the bale chute assembly 140. A single chain center-pull drive system can be used in another embodiment.

As shown in FIG. 1C, once contact of the foot plate 132 is made with the bale 150, the bale stuffer assembly 130 begins to urge the bale 150 off the bale cart 120 and into the bale chute assembly 140. Perforations can be provided in the bale bag 152 so that air (represented by arrows) may escape as the bale 150 is urged in the bag 152. Prior to the bale 150 entering the bale chute 141, the bale chute halves 141*a*, 141*b* are spring loaded such that the discharge ends 143 of the bale chute halves 141*a*, 141*b* are in close proximity to each other, as shown in FIG. 8A. As the bale 150 is urged into the bale chute 141 by the bale stuffer assembly 130, the front end of the bale makes contact with each of the chute halves 141*a*, 141*b*, causing the distal ends 143 of the chute halves 141*a*, 141*b* to be urged away from each other (FIG. 8B).

Figure 7:
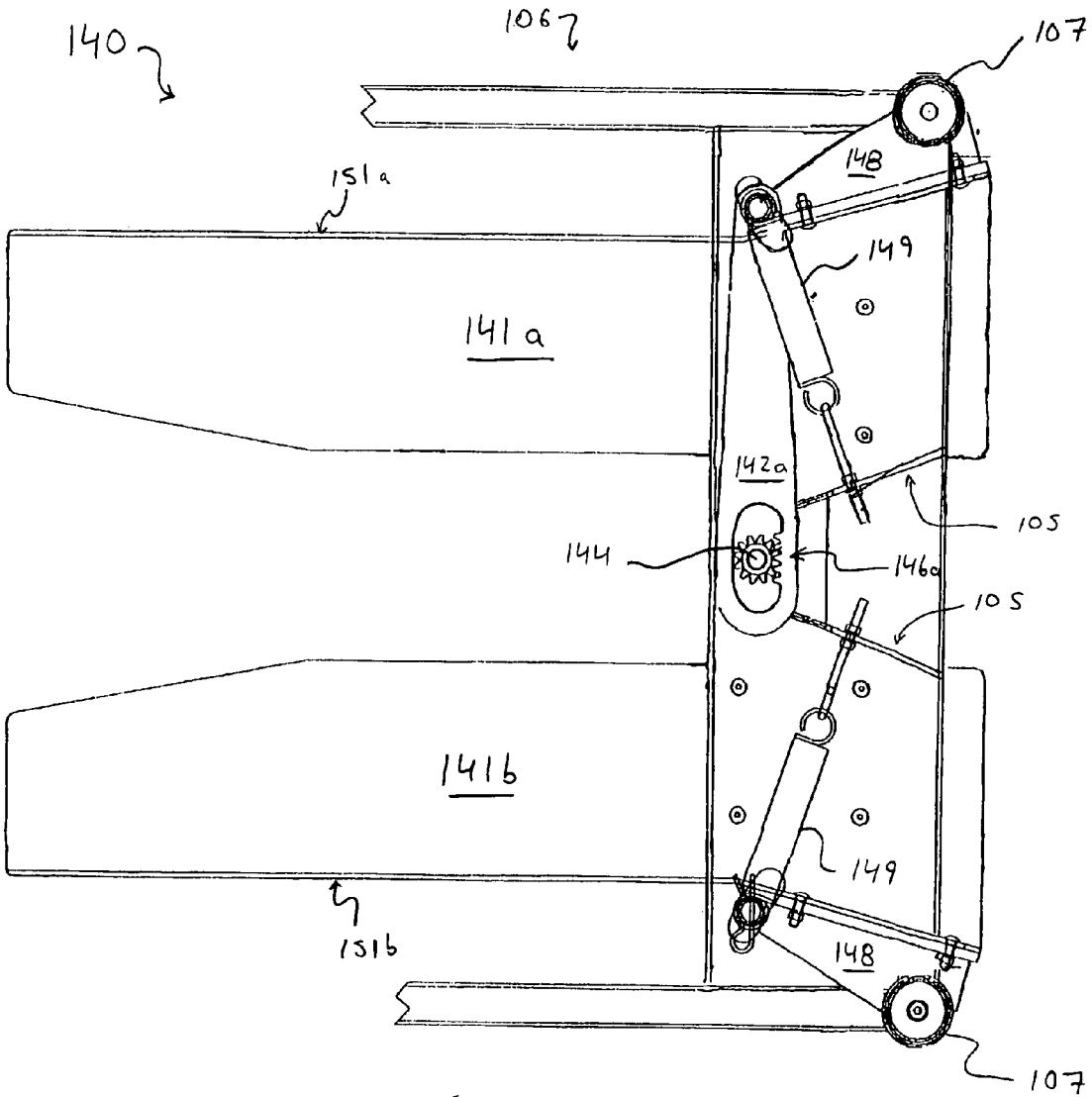
FIG. 7 is a bottom view of the bale chute assembly of the bale bagging assembly, as shown in FIG. 1.

The bale bagging apparatus in one embodiment includes a bale chute assembly 140 in which the bale chute halves 141*a,* 141*b* are configured to open simultaneously regardless of whether or not the cotton bale 150 is properly aligned with the bale chute 141. As shown in FIG. 7, the bale bagging assembly 140 includes bale chute halves 141*a,* 141*b*, each of which is pivotally mounted to a respective support post 107 of the bagger frame 106 by a hinge bracket 148. Each bale chute half 141*a,* 141*b* also includes a timing link 142*a*, 142*b*, respectively, and an extension spring 149. For ease of description, timing link 142*b* for bale chute half 141*b* has been removed in FIG. 7. A first end of each timing link 142*a*, 142*b* includes a rack 146*a*, 146*b* that is configured to interact with a stationary pinion gear 144. The pinion gear can be mounted on a portion of the bagger frame 106. The second end of each timing link 142*a*, 142*b* is rotatably secured to a portion of its respective bale chute half 141*a*, 141*b*, respectively, in the instant case that being a portion of the respective hinge bracket 148. As well, each extension spring 149 has a first end rotatably secured to the same portion of its respective bale chute halve 141*a,* 141*b* as is the second end of the respective timing link 142*a*, 142*b*. The second end of each extension spring 149 is further secured to a portion of the bagger frame 106, the action of each extension springs 149 being to return the respective bale chute half 141*a,* 141*b* to the at rest positions (FIG. 8A) when a cotton bale 150 is not urging the distal ends 143 of the bale chute halves 141*a,* 141*b* away from each other.

Figure 8B:
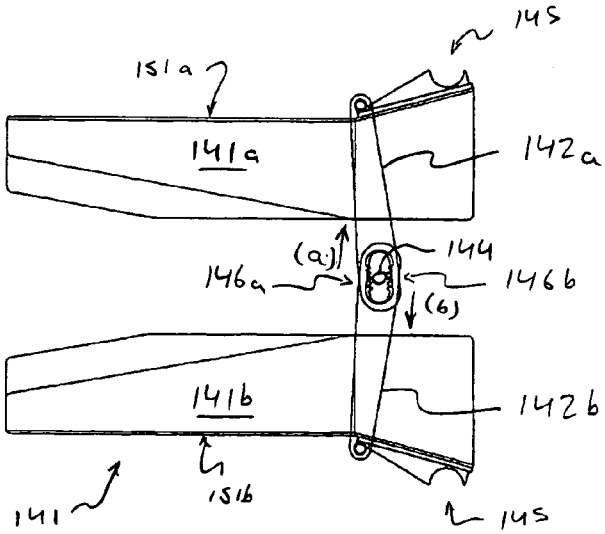
Figure 8C:
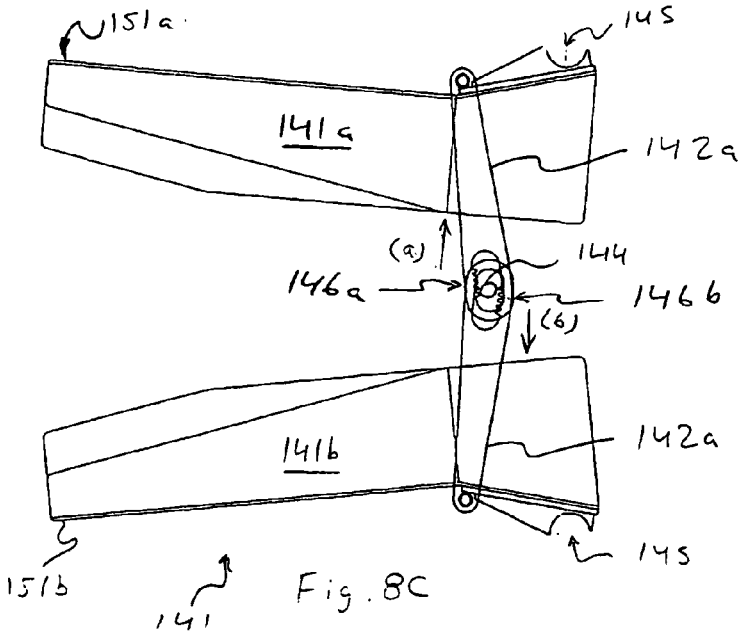

Referring now to FIGS. 8A–8C, the timing links 142*a*, 142*b* are disposed about the pinion gear 144 such that the rack 146*a* of timing link 142*a* is disposed on the opposite side of the pinion gear 144 as is the rack 146*b* of timing link 142*b*. As such, as a bale 150 begins to enter the bale chute 141, whether the bale is aligned properly or not, the bale chute halves 141*a,* 141*b* will begin to pivot outwardly about their respective pivot points 145 (post 107 of FIG. 7) simultaneously. For example, as shown in FIG. 8B, as bale chute half 141*a* begins to rotate outwardly, the timing link 142*a* will be urged in the direction indicated by arrow (a). Therefore, the rack 146*a* of timing link 142*a* will interact with the pinion gear 144, causing the pinion gear 144 to rotate in a clockwise direction. In that rack 146*b* interacts with the pinion gear 144 but is located opposite of rack 146*a*, clockwise rotation of the pinion gear 144 will cause rack 146*b*, and subsequently timing link 142*b*, to move in the direction indicated by arrow (b). As such, bale chute half 141*b* will rotate outwardly simultaneous with the rotation of bale chute half 141*a*. As shown in FIG. 8C, bale chute halves 141*a,* 141*b* will continue to rotate outwardly away from each other until the approximate maximum width portion of the bale 150 has been urged into the bale chute 141. At this instant, the exterior surfaces 151*a*, 151*b* of each bale chute half 141*a*, 141*b*, respectively, exert the greatest amount of retention force on the bale bag 152.

Once the bale chute halves 141*a*, 141*b* have rotated outwardly such that friction between the outer surfaces 151*a,* 151*b* of the bale chute halves 141*a,* 141*b* is adequate to retain the bale bag 152 on the bale chute 141, the pincher assembly 200, including the upper pincher bar assembly 202 and the lower pincher bar assembly 222, releases the grip on the open end 156 of the bale bag 152. The carriage assemblies 180 can be retracted to the back end (or moveable end) of the carriage frame 160. The bagger arms 182*a*, 182*b* remain in the extended position until the carriage assembly 180 is clear of the bale chute 141. FIG. 1D shows the carriage assembly 180 being retracted to the back end of the carriage frame 160. The carriage assembly 180 is chain driven with the drive gear 166*a* being mounted at the back end of the carriage frame 160 and the idler gear 166*b* being mounted at the pivot end 163 of the carriage frame 160.

As shown in FIG. 1E, as the carriage assembly 180 is retracted to the back end of the carriage frame 160, the bagger arms 182*a*, 182*b* are moved to their retracted positions by retracting the piston 186 into the arm air cylinder 184. However, a gap exists between the upper pincher bar assembly 202 and the lower pincher bar assembly 222 to allow the next bale bag 152 to be properly grasped, as discussed hereafter. Simultaneously, the entire carriage frame 160 is rotated upwardly about pivot ends 163 by retracting each piston 169 into its respective bagger frame air cylinder 168, thereby allowing the cotton bale 150 to be moved onto the scale 118 for weighing. Also shown, in preparation for the cotton bale 150 to be urged off the bale bagging apparatus 100, the tray 112 of the up-ender assembly 110 is urged into its horizontal position by extending piston 115 from its air cylinder 114.

Figure 9:
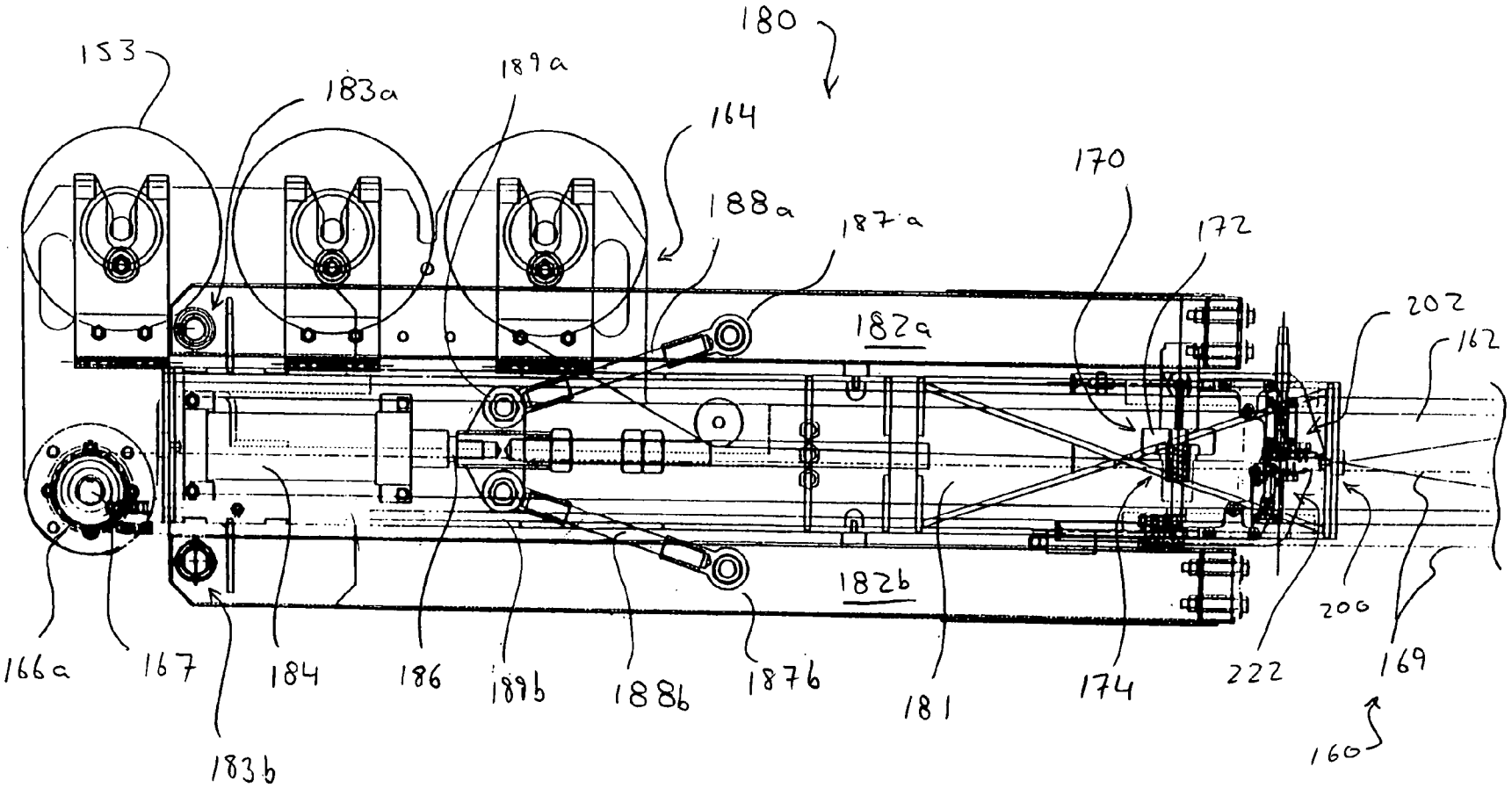
FIG. 9 is a side view of the carriage assembly, as shown in FIG. 1, in a fully retracted position.

As shown in FIG. 1F, the cotton bale 150 has been urged onto the scale 118 for weighing. As well, carriage assembly 180 has been fully retracted to the back end of the carriage frame 160 and the bagger arms 182*a*, 182*b* are in their fully retracted positions as well, as best seen in FIG. 9. From the fully retracted position shown in FIG. 9, the bagger arms 182*a*, 182*b* are deployed by urging the piston 186 outwardly from the arm air cylinder 184. In that the first ends 189*a*, 189*b* of the links 188*a* and 188*b* are rotatingly connected to the piston 186, the links 188*a*, 188*b* will rotate in counter-clockwise and clockwise fashion, respectively. Therefore, the links 188*a*, 188*b* will cause similar outward rotation of their respective bagger arms 182*a*, 182*b* about the pivot points 183*a*, 183*b*, respectively. As shown, the carriage frame 160 also includes a clamping device 170 mounted between the side rails 162. The clamping device includes a stationary anvil 172 and a pneumatically operated clamp bar 174. The clamping device 170 is located behind the pincher assembly 200 when the bagger arms 182*a*, 182*b* are in their fully retracted positions.

Referring now to FIGS. 10A–10F, the manner in which the pincher assembly 200 both grabs and subsequently opens each bale bag 152 is addressed. As shown, a preferred embodiment, among others, of the pincher assembly 200 includes an upper pincher bar assembly 202 having a first pair of pincher blocks 204 and a second pair of pincher blocks 206, the upper pincher bar assembly 202 being supported at each end by a pair of bagger arms 182*a* (not shown), and a lower pincher bar assembly 222 including a first pair of pincher blocks 224 and a second pair of pincher blocks 226, the lower pincher bar assembly 222 being supported at both ends by the pair of bagger arms 182*b* (not shown). As shown, both the first pairs of pincher blocks 204, 224 and both the second pairs of pincher blocks 206, 226 each include both a stationary pincher block and a moving pincher block, examples of which are shown in FIGS. 11A–11C and 12A–12B, respectively.

Figure 11A:
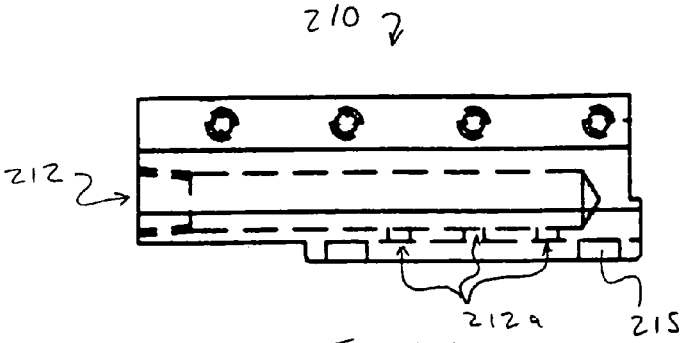
Figure 11C:
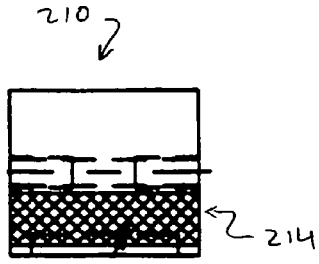
Figure 11B:
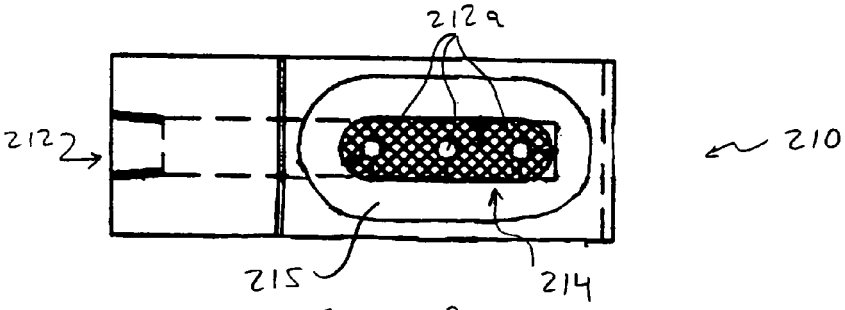
Figure 12A:
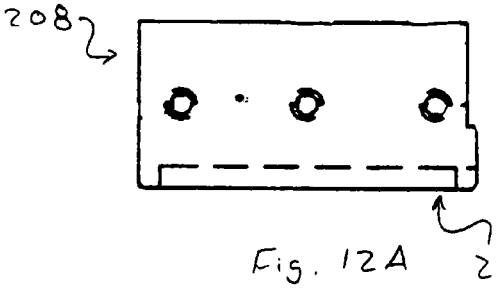
FIGS. 12A and 12B are front and side views, respectively, of a stationary pincher block of the pincher assembly shown in FIGS. 10A–10F.
Figure 12B:
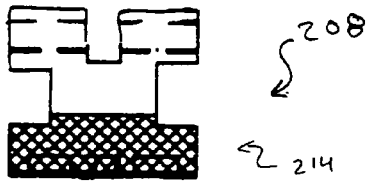

As shown in FIGS. 11A–11C, an exemplary moving pincher block 210 includes a roughened contact surface 214, a vacuum channel 212, a recess 215 for receiving a grommet 216 (FIG. 13A), and one or more holes 212*a* for placing the vacuum channel 212 in fluid communicate with the roughened surface 214 that is formed within the perimeter of the recess 215. As shown, the roughened surface 214 is a plurality of pyramids having sharp points that is machined into the pincher block. The sharp points are capable of piercing the bagging material when vacuum is applied to the moving pincher blocks, as discussed hereafter. Note also, as shown in FIG. 11C, another roughened surface 214 may be provided on the side of the moving pincher block 210 which is adjacent the stationary pincher block 208 of a given pair of pincher blocks. As shown in FIGS. 12A and 12B, the stationary pincher block 208 includes a recess 215 for receiving a grommet 216. The stationary pincher block 208 also includes a roughened surface 214 on the side of the stationary pincher block 208, which is adjacent the roughened side of the moving pincher block 210 for a given pincher block pair.

Figure 13A:
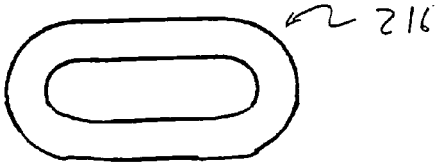
FIGS. 13A and 13B are bottom and cross-sectional views, respectively, of a grommet for use in the pincher blocks of FIGS. 11A–11C and 12A–12B.
Figure 13B:
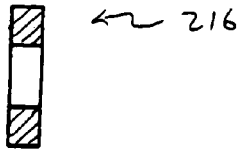

FIGS. 13A and 13B show an exemplary grommet 216 for use in the moving pincher block 210 and stationary pincher block 208. The grommet 216 can be constructed of urethane or any other material suitable for creating the desired amount of gripping force on the bagging material. Grommet 216 protrudes approximately ⅛ inch beyond the bottom of the pincher block in which it is installed. Other dimensions and materials, such as rubber, plastics, composites, etc., are possible for use in constructing the grommet.

Figure 10A:
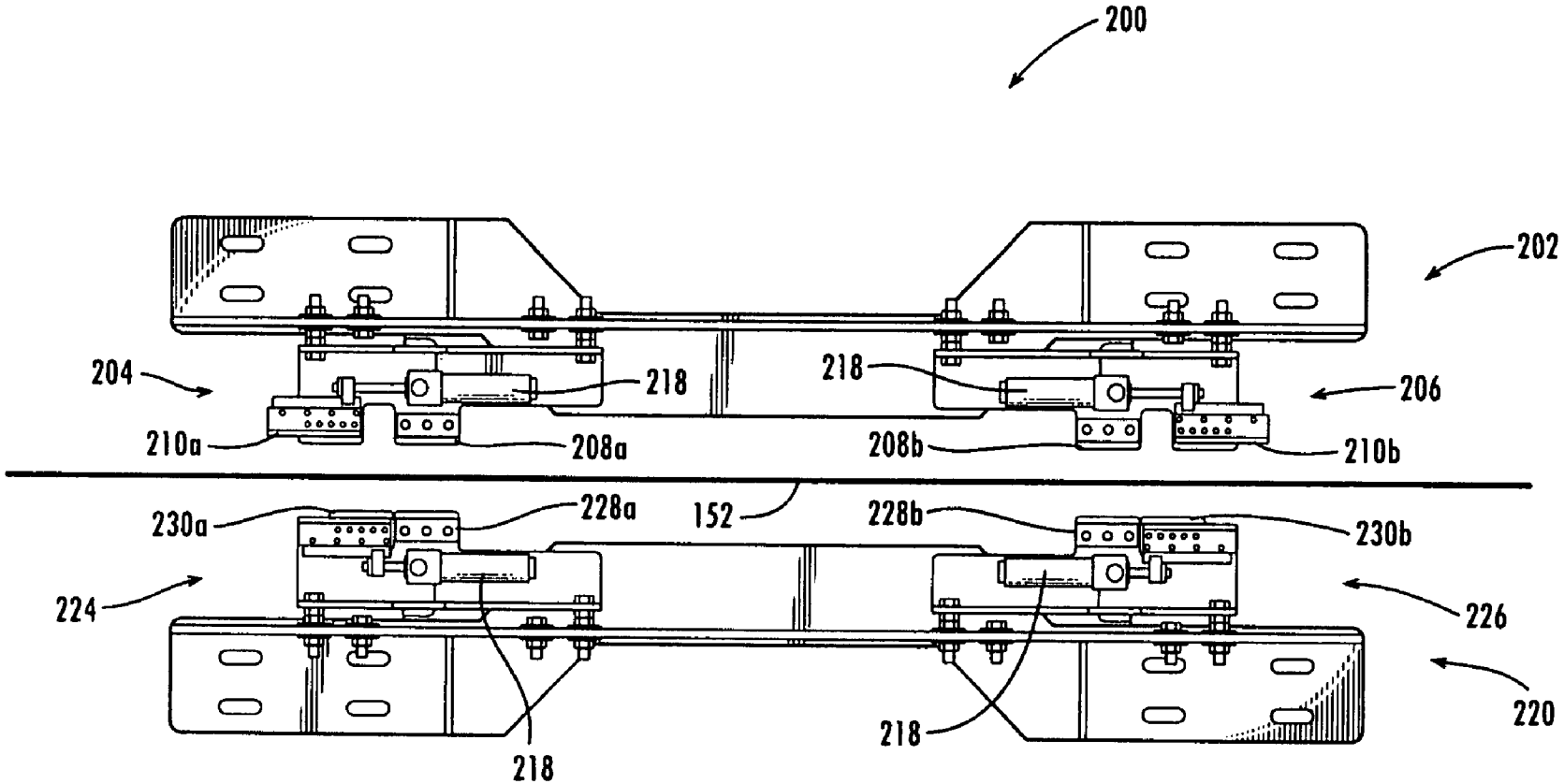
FIGS. 10A–10F are front views of the pincher bar assembly of the bale bagging assembly, as shown in FIG. 1.

As shown in FIG. 10A, the upper pincher bar assembly 202 and lower pincher bar assembly 222 are positioned above and below, respectively, the end of a bale bag 152 that comes off the roll 153 of bale bags 152 subsequent to the bale bag 152 that is positioned around the cotton bale 150. The bale bagging apparatus 100 in one embodiment is used with polyethylene bale bags 152 having a thickness within the range of 5 to 7 mils, preferably 6 mils, such that the free end of the bale bag 152 that is to be opened remains substantially planar during unrolling and tearing operations, as will be discussed hereafter. The position of the upper pincher bar assembly 202 and lower pincher bar assembly 222 shown in FIG. 10A corresponds to the position of the bagger arms 182*a* and 182*b* as shown in FIG. 1E, that being the mid-position when the bagger arms 182*a* and 182*b* are not fully retracted. Prior to urging the upper pincher bar assembly 202 and lower pincher bar assembly 222 together, the moving pincher blocks 230*a* and 230*b* of the first and second pairs of pincher blocks 224 and 226 of the lower pincher bar assembly 222 are moved inwardly such that they contact the stationary pincher blocks 228*a* and 228*b* of each pincher block pairs 224 and 226. All of the moving pincher blocks 210*a*, 210*b*, 230*a*, 230*b* are moved by way of block air cylinders 218. In one embodiment, when a moving pincher block is in the "at rest" position away from the stationary pincher block, approximately 1 inch exists between the moving pincher block and the stationary pincher block.

Figure 10B:
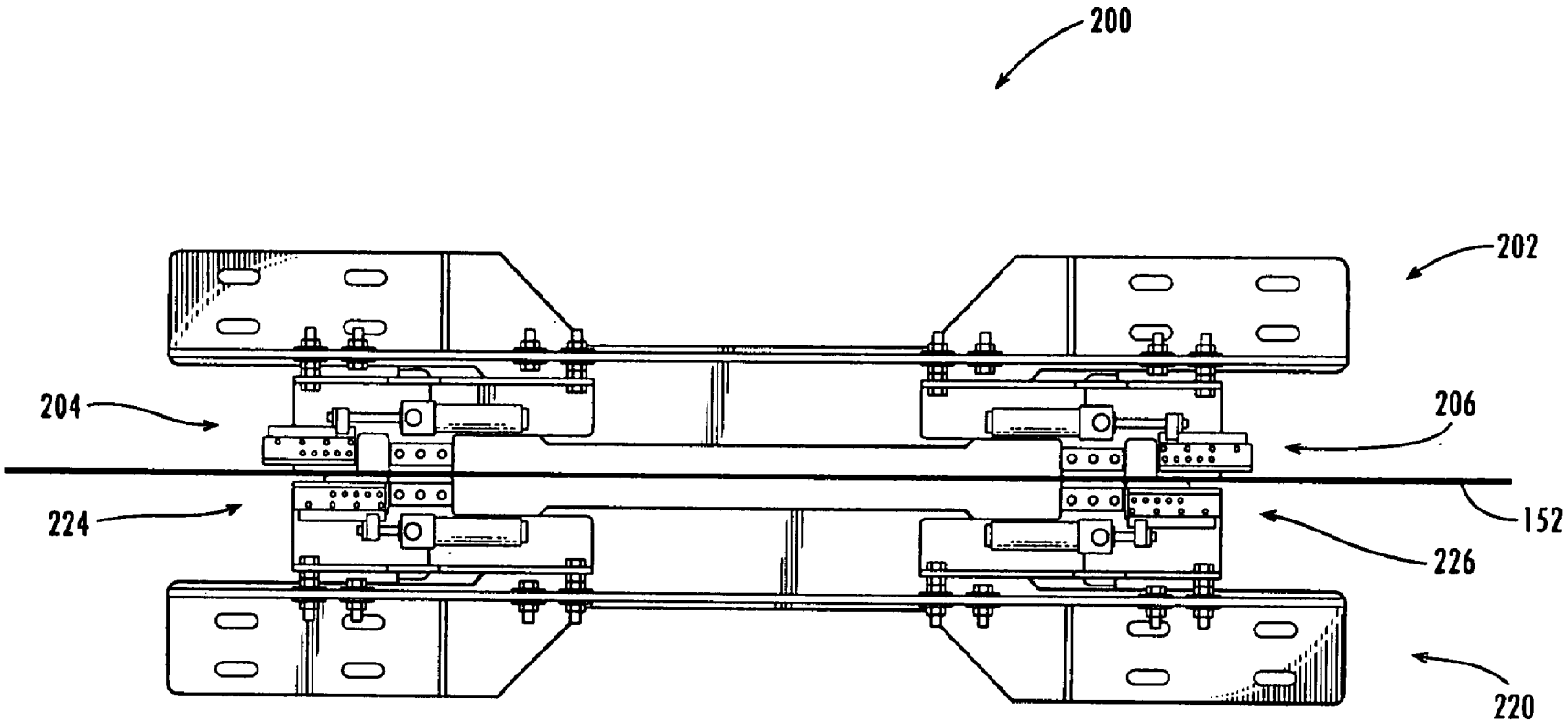
Figure 10L:
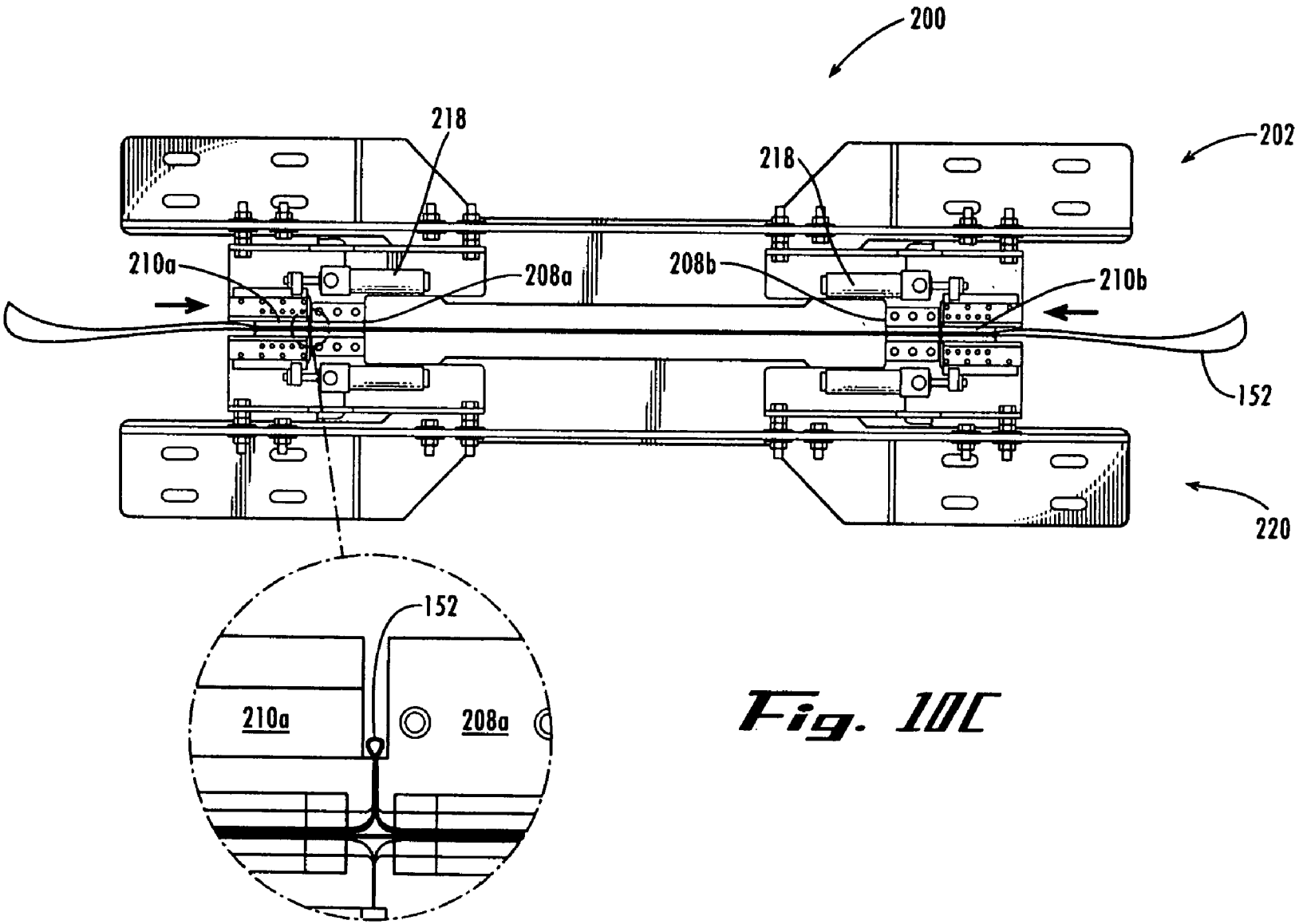

Next, as shown in FIG. 10B, the upper and lower pincher bar assemblies 202 and 222 are brought together such that the bale bag 152 is sandwiched between the first pair of pincher blocks 204 and 224 and the second pair of pincher blocks 206 and 226. The pincher assembly 200 will be in this configuration when the bagger arms 182*a*, 182*b* are in their fully retracted positions, as best seen in FIG. 9. Next, as shown in FIG. 10C, the moving pincher blocks 210*a*, 210*b* of the first pairs of pincher blocks 204, 224, respectively, are urged inwardly by respective block air cylinders 218 toward stationary pincher blocks 208*a*, 208*b*, respectively. However, prior to moving the moving pincher blocks 210*a*, 210*b*, a vacuum is applied through the respective vacuum channels 212 of moving pincher blocks 210*a*, 210*b*. This vacuum helps to draw portions of the top layer of the bale bag 152 into contact with the roughened surface 214 area within the perimeter of the grommets 216 of the moving pincher blocks 210*a*, 210*b*.

The coefficient of friction between the grommets 216 that are recessed-mounted to each pincher block and the bag is more than the coefficient of friction of the upper layer of the bag on the lower layer of the bag. Therefore, the portion of the upper layer of the bag that is disposed between the moving pincher blocks 210*a*, 210*b* and the stationary pincher blocks 208*a*, 208*b* slides relative to the bottom layer of the bag, and hence upward between moving pincher blocks 210*a*, 210*b* and the stationary pincher blocks 208*a*, 208*b*. As such, these portions of the polyethylene bagging are now securely held between the moving and stationary pincher blocks. Thus, the vacuum to the moving pincher blocks 210*a*, 210*b* can be secured.

Figure 10D:
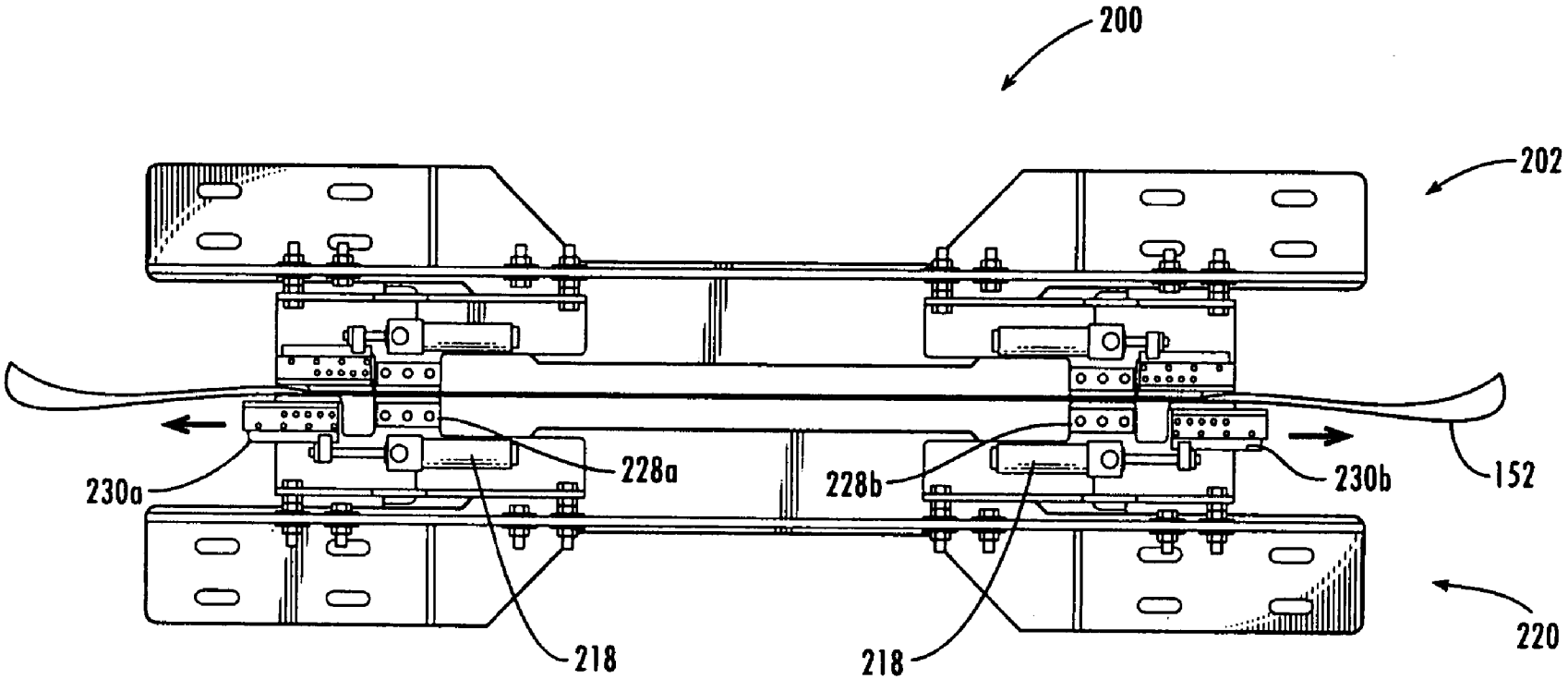

As shown in FIG. 10D, the moving pincher blocks 230*a*, 230*b* of the second pair of pincher blocks 206 and 226 are urged outwardly away from the stationary pincher blocks 228*a*, 228*b*. A vacuum is provided to the moving pincher blocks 230*a*, 230*b* by way of vacuum channels 212, as previously noted. The holes 212*a* which are in fluid communication with the roughened surface 214 of each moving pincher block 230*a*, 230*b* allow the vacuum to draw the bagging into contact with the roughened surface 214 that exists within the perimeter of the grommet 216 of each moving pincher block 230*a*, 230*b*.

Figure 10E:
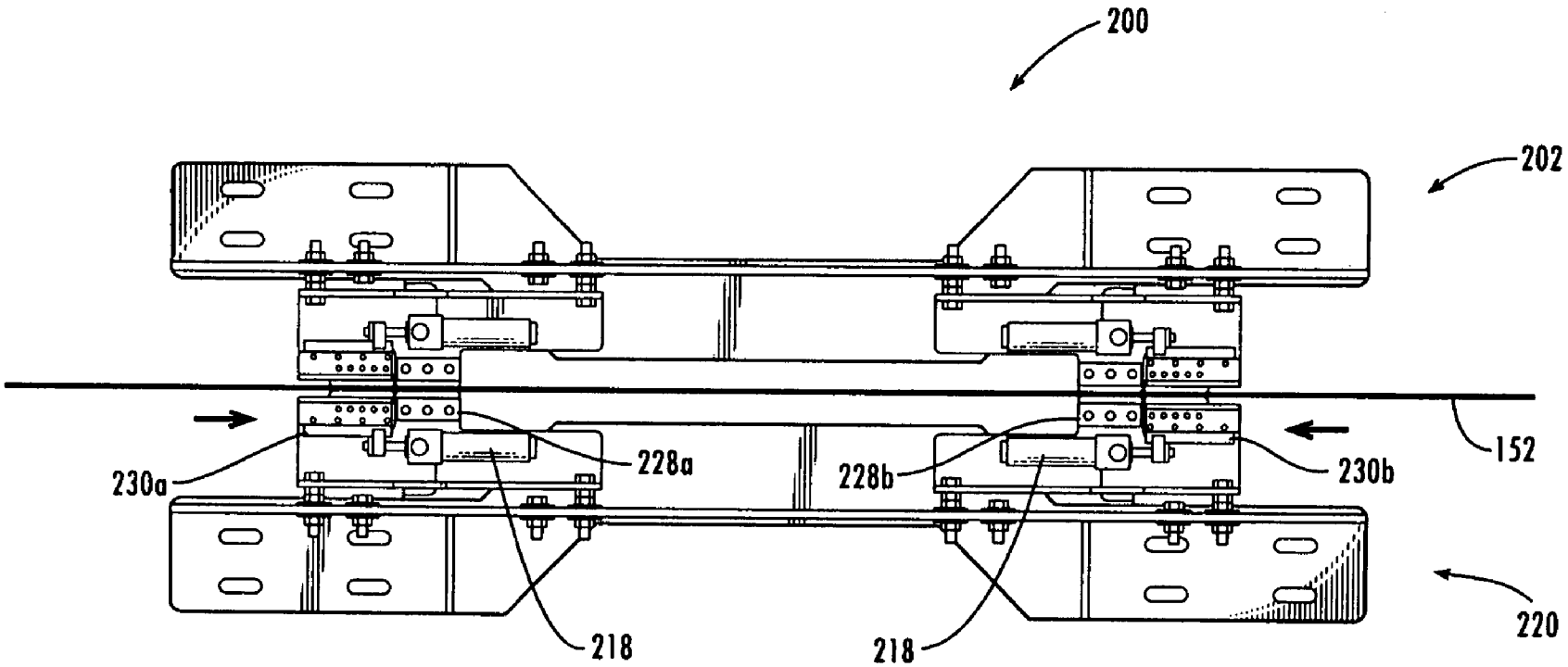

As shown in FIG. 10E, the moving pincher blocks 230*a*, 230*b* are urged inwardly toward the stationary pincher blocks 228*a*, 228*b* in a manner similar to that previously discussed with regard to moving pincher blocks 210*a*, 210*b*. Similarly, portions of the bagging that are disposed between the moving pincher blocks 230*a*, 230*b* and stationary pincher blocks 228*a*, 228*b* slide relative to the upper layer of bagging, resulting in those portions being pinched between moving pincher blocks 230*a*, 230*b* and stationary pincher blocks 228*a*, 228*b*, respectively. With the second pair of pincher blocks 206, 226 each pinching a portion of the bagging, vacuum is secured to the moving pincher blocks 230*a*, 230*b*.

Figure 10F:
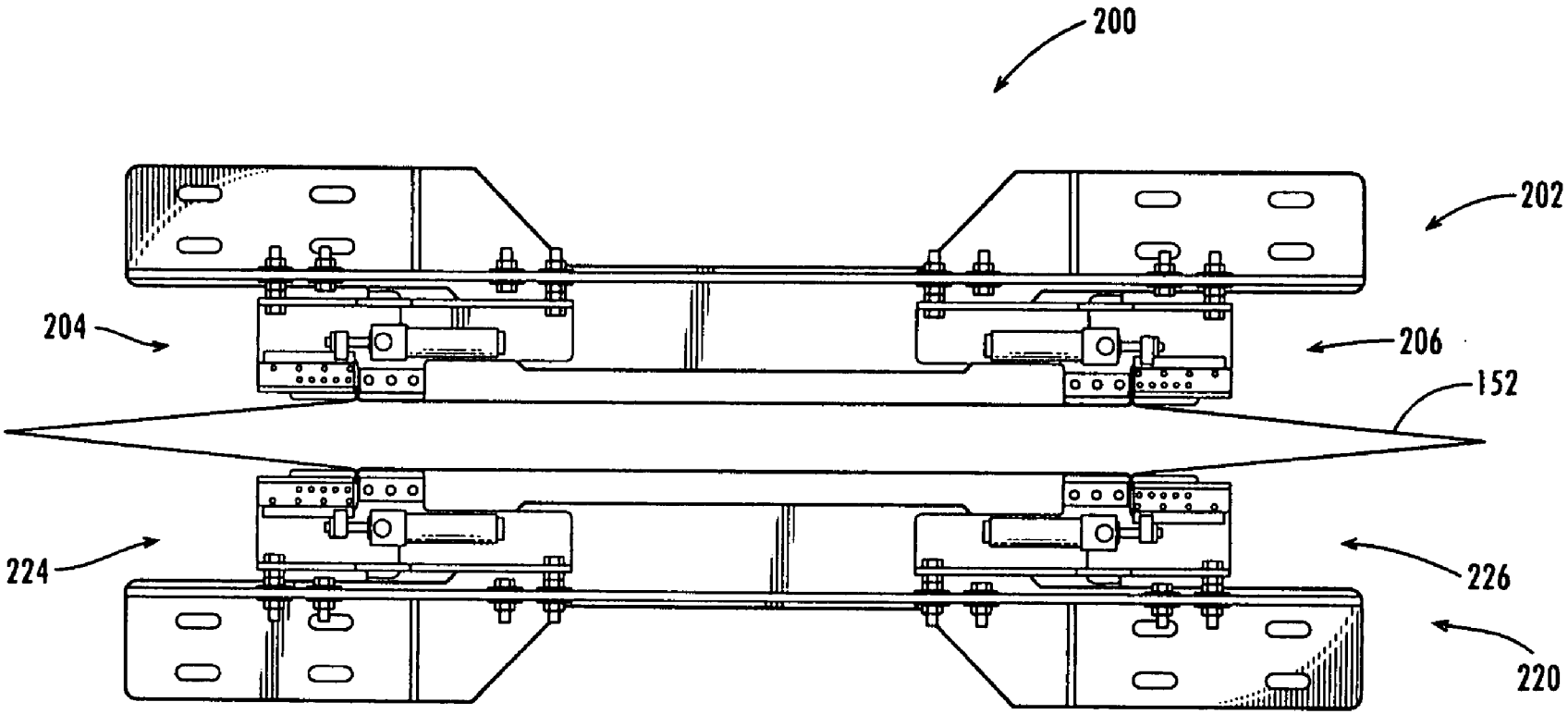

As shown in FIG. 10F, the bag 152 can be opened by urging the upper pincher bar assembly 202 and lower pincher bar assembly 222 away from each other as the carriage assemblies 180 are urged forward along their respective side rails 162 in preparation for installing the bale bag 152 on the bale chute 141, as addressed hereafter in the discussion of FIG. 1J. Embodiments are envisioned wherein the bale bags are opened by vacuum only. For example, an alternate embodiment can have opposed pairs of suction cups (not shown) rather than the pincher assembly 200 as disclosed.

Referring now to FIG. 1G, when the cotton bale 150 is on the scale 118, the bale stuffer assembly 130 is partially retracted from the cotton bale 150 so that the bale 150 can be accurately weighed without interference from the bale stuffer assembly 130. As shown in FIG. 1H, the bale stuffer assembly 130 urges the cotton bale 150 off the scale 118 and onto the tray 112 of the up-ender assembly 110. The tray 112 has a base plate 113 that prevents the cotton bale 150 from being pushed farther than desired by the bale stuffer assembly 130, thereby preventing the cotton bale 150 from being inadvertently urged off the bale bagging apparatus 100. As shown in 1I, the tray 112 and associated cotton bale 150 are lowered into the vertical position by retracting the piston 115 into the air cylinder 114. As such, the cotton bale 150 is in position to be urged away from the discharge end of the bale bagging apparatus 100 so that the next cotton bale 150 can be placed in a bale bag 152. The cotton bale 150 is moved away from the discharge end of the bale bagging apparatus 100 with the pusher assembly 116. The push plate 119 is brought into contact with the cotton bale by extending the piston 121 outwardly from the air cylinder 117.

As shown in FIG. 1J, once the bagged cotton bale 150 is moved away from the bale bagging apparatus 100, the carriage assemblies 180 can be urged forward along their respective side rails 162 so that the next bale bag 152 may be placed on the bale chute 141. As the carriage assembly 180 is urged toward the pivot end 163 of the carriage frame 160, the piston 186 is urged out of the arm air cylinder 184, thereby causing the bagger arms 182*a*, 182*b* to move outwardly from the carriage 181, as previously discussed. As such, the upper pincher bar assembly 202 and lower pincher bar assembly 222 are urged away from each other, thereby causing the bale bag 152 to open. Simultaneously, the bagger frame air cylinders 168 urge the pistons 169 outwardly causing the back end of the carriage frame 160 to be lowered until it reaches a horizontal position as shown in FIG. 1K. The carriage assemblies 180 continue to travel along the respective side rails 162 until the bale bag 152 is fully installed on the bale chute 141. As the bale bag 152 is pulled over the bale chute 141, eventually the tear point between the bag 152 and the subsequent bag on the roll 153 (not shown) will travel between the anvil 172 and clamp bar 174 of the clamping device 170. Sensors are used to detect when the tear point is approximately 6 inches beyond the clamping device 170, at which point the anvil 172 is forced into contact with the clamp bar 174, thereby securing the bale bag 152 therebetween. Continued motion of the carriage assembly 180 causes the bale bag 152 being installed on the chute 141 to tear away from the subsequent bale bag 152 along the tear line. The bale bag positioned between the anvil 172 and clamp bar 174 is now properly positioned for the next pinching operation of the pincher assembly 200.

It should be emphasized that the above-described embodiments of the present bale bagging apparatus, particularly any "preferred" embodiments, are merely possible examples of implementations, and are merely set forth for a clear understanding of the principles of the bale bagging apparatus. Many variations and modifications may be made to the above-described embodiment(s) of the bale bagging apparatus without departing substantially from the spirit and principles of the bale bagging apparatus. All such modifications and variations are intended to be included herein within the scope of this disclosure and the present bale bagging apparatus and protected by the following claims.

What is claimed is:

1. A bagging apparatus for placing a bale bag about a bale, the bagging apparatus comprising:

a frame assembly, the frame assembly including a head frame, a tail frame, a bagger frame, and a first and a second guide rail, the first and second guide rails being secured at a first end to the head frame and at a second end to the tail frame, the first and second guide rails being parallel to each other;

a bale stuffer assembly supported between the guide rails and movable thereon, the bale stuffer assembly including a head with a plurality of guide wheels mounted thereon, and a foot plate extending downwardly from the head, the plurality of guide wheels being arranged and configured to rotatably contact both the first and second guide rails;

a bale chute assembly including a bale chute and a timing assembly, the bale chute including a first bale chute half and a second bale chute half, the first and second bale chute halves each being pivotally mounted to a portion of the bagger frame such that the first and the second bale chute halves oppose one another, the timing assembly including a first timing link, a second timing link, and a pinion gear, wherein a first end of the first timing link is rotatably mounted to the first bale chute half and a second end of the first timing link is in communication with the pinion gear, a first end of the second timing link is rotatably mounted to the second bale chute half and the second end of the second timing link is in communication with the pinion gear, the second ends of the first and second timing links being arranged and configured such that rotation of the pinion gear in a first direction urges the first and second timing links in opposite directions; and a bagging assembly including:

a U-shaped carriage frame having a first side rail and a second side rail, a pivot end, a movable end, and at least one air cylinder, the pivot end including a first end of the first side rail and a first end of the second side rail, each being pivotally mounted on opposing sides of the bale chute, the movable end being secured to the tail frame by the at least one air cylinder;

a first carriage assembly and a second carriage assembly movably mounted on the first and the second side rail, respectively, both the first and the second carriage assemblies including a carriage mounted to the respective side rail, an upper bagger arm and a lower bagger arm, the upper and lower bagger arms being rotatably secured to their respective carriage and being configured to open simultaneously;

a pincher assembly including an upper pincher bar assembly including a first pair and a second pair of pincher blocks, a lower pincher bar assembly including a first pair and a second pair of pincher blocks, the upper pincher bar assembly being supported by the upper bagger arms and the lower pincher bar assembly being supported by the lower bagger arms; and wherein the first and the second upper pairs of pincher blocks and the first and the second lower pairs of pincher blocks are each configured to secure a portion of the bale bag between the pincher blocks of the respective pincher block pair, thereby causing the bale bag to open as the upper and lower pincher bar assemblies are moved in opposite directions.

2. The bagging apparatus of claim 1, wherein the plurality of guide wheels further includes a first pair of guide wheels and a second pair of guide wheels, each first and second pairs of guide wheels including an upper guide wheel and a lower guide wheel, wherein the upper and the lower guide wheels of the first pair of guide wheels abut an upper surface and a lower surface, respectively, of the first guide rail, and the upper and the lower guide wheels of the second pair of guide wheels abut an upper and a lower surface, respectively, of the second guide rail.

3. The bagging apparatus of claim 2, wherein both the first and the second guide rails are square in cross-section, and both the first and the second guide rails are oriented such that an opposed pair of comers of each of the first and the second guide rails are disposed in a vertical plane.

4. The bagging apparatus of claim 2, wherein each guide wheel has an axis of rotation, and the axes of rotation of the upper and the lower guide wheels of the first pair of guide wheels and the axes of rotation of the upper and the lower guide wheels of the second pair of guide wheels are perpendicular to each other, respectively.

5. The bagging apparatus of claim 1, wherein the second end of the first timing link includes a first rack, the second end of the second timing link includes a second rack, and the first and the second racks abut the pinion gear opposite one another.

6. The bagging apparatus of claim 1, wherein the first and the second upper pairs of pincher blocks and the first and the second lower pairs of pincher blocks each include a stationary pincher block and a movable pincher block.

7. The bagging apparatus of claim 6, wherein for both the first and the second upper pairs of pincher blocks and the first and the second lower pairs of pincher blocks, the movable pincher block is disposed outwardly from the stationary pincher block relative to a longitudinal axis of the bagging apparatus.

8. The bagging apparatus of claim 7, wherein each movable pincher block further includes a vacuum channel in fluid communication with a surface of the movable pincher block that is configured to be placed adjacent the bale bag.

9. The bagging apparatus of claim 7, wherein a grommet extends outwardly from a surface of each stationary pincher block and each movable pincher block, the grommets being disposed such that the grommets contact the bale bag when the upper and the lower pincher bar assemblies are urged together.

10. A bale chute assembly for use with a bale bagging apparatus including a frame and a bale stuffer, the bale stuffer being supported by the frame, the bale chute assembly comprising:

a bale chute including a first bale chute half and a second bale chute half, the first and the second bale chute halves being pivotally mounted to a portion of the frame; and a timing assembly including a first timing link, a second timing link, and a pinion gear, wherein a first end of the first timing link is pivotally mounted to the first bale chute half and a second end of the first timing link is in communication with the pinion gear, a first end of the second timing link is pivotally mounted to the second bale chute half and the second end of the second timing link is in communication with the pinion gear, the second ends of the first and second timing links being arranged and configured such that rotation of the pinion gear in a first direction urges the first and second timing links in opposite directions.

11. The bale chute assembly of claim 10, wherein the second end of the first timing link includes a first rack, the second end of the second timing link includes a second rack, and the first and the second racks abut the pinion gear opposite one another.

12. The bale chute assembly of claim 10, further comprising a first extension spring and a second extension spring, wherein a first end of the first extension spring is secured to the first bale chute half and a second end of the first extension spring is secured to the frame, a first end of the second extension spring is secured to the second bale chute half and a second end of the second extension spring is secured to the frame, the first and the second extension springs being arranged to urge the first and the second bale chute halves together.

13. A bagging apparatus for placing a bale bag about a bale, the bagging apparatus comprising:

a frame assembly, the frame assembly including a head frame, a tail frame, and a guide rail extending between the head frame the tail frame;

a bale stuffer assembly supported by the guide rail and movable thereon;

a bale chute assembly including a bale chute, the bale chute including a first bale chute half and a second bale chute half, the first and second bale chute halves each being pivotally mounted to a portion of the frame assembly such that the first and the second bale chute halves oppose one another; and a bagging assembly including:

a U-shaped carriage frame having a first side rail and a second side rail, a pivot end, and a movable end, the pivot end including a first end of the first side rail and a first end of the second side rail, each being pivotally mounted on opposing sides of the bale chute;

a first carriage assembly and a second carriage assembly movably mounted on the first and the second side rail, respectively, both the first and the second carriage assemblies including a carriage mounted to the respective side rail, an upper bagger arm and a lower bagger arm, the upper and lower bagger arms being rotatably secured to their respective carriage and being configured to open simultaneously;

a pincher assembly including an upper pincher bar assembly and a lower pincher bar assembly, the upper pincher bar assembly being supported by the upper bagger arms and the lower pincher bar assembly being supported by the lower bagger arms; and wherein the upper and lower pincher bar assemblies are each configured to secure a portion of the bale bag, thereby causing the bale bag to open as the upper and lower pincher bar assemblies are moved in opposite directions.

14. The bagging apparatus of claim 1, wherein:

the upper pincher bar assembly further includes a first pair and a second pair of pincher blocks;

the lower pincher bar assembly further includes a first pair and a second pair of pincher blocks; and the first and the second upper pairs of pincher blocks and the first and the second lower pairs of pincher blocks are each configured to secure a portion of the bale bag between the pincher blocks of the respective pincher block pair such that the bale bag opens as the upper and lower pincher bar assemblies are moved in opposite directions.

15. The bagging apparatus of claim 14, wherein the first and the second upper pairs of pincher blocks and the first and the second lower pairs of pincher blocks each include a stationary pincher block and a movable pincher block.

16. The bagging apparatus of claim 15, wherein for both the first and the second upper pairs of pincher blocks and the first and the second lower pairs of pincher blocks, the movable pincher block is disposed outwardly from the stationary pincher block relative to a longitudinal axis of the bagging apparatus.

17. The bagging apparatus of claim 16, wherein each movable pincher block further includes a vacuum channel in fluid communication with a surface of the movable pincher block that is configured to be placed adjacent the bale bag.

18. The bagging apparatus of claim 16, wherein a grommet extends outwardly from a surface of each stationary pincher block and each movable pincher block, the grommets being disposed such that the grommets contact the bale bag when the upper and the lower pincher bar assemblies are urged together.

19. The bagging apparatus of claim 13, further including at least one air cylinder disposed between the movable end of the U-shaped carriage frame and the frame assembly.

* * * * *